US010551758B2

(12) United States Patent
Tanaka et al.

(10) Patent No.: US 10,551,758 B2
(45) **Date of Patent: *Feb. 4, 2020**

(54) TONER

(71) Applicant: CANON KABUSHIKI KAISHA, Tokyo (JP)

(72) Inventors: Maho Tanaka, Tokyo (JP); Kunihiko Nakamura, Gotemba (JP); Kenta Kamikura, Yokohama (JP); Fumiya Hatakeyama, Kawasaki (JP); Akane Masumoto, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/974,969

(22) Filed: May 9, 2018

(65) Prior Publication Data

US 2018/0329328 A1 Nov. 15, 2018

(30) Foreign Application Priority Data

May 15, 2017 (JP) ..... 2017-096223
Oct. 3, 2017 (JP) ..... 2017-193187

(51) Int. Cl.
*G03G 9/093* (2006.01)
*G03G 9/087* (2006.01)
*G03G 9/08* (2006.01)

(52) U.S. Cl.
CPC ..... *G03G 9/09335* (2013.01); *G03G 9/0821* (2013.01); *G03G 9/0825* (2013.01); *G03G 9/08728* (2013.01); *G03G 9/08755* (2013.01); *G03G 9/08797* (2013.01); *G03G 9/09328* (2013.01); *G03G 9/09364* (2013.01); *G03G 9/09371* (2013.01)

(58) Field of Classification Search
CPC ..... G03G 9/09328; G03G 9/09321; G03G 9/09335; G03G 9/0825
USPC ..... 430/110.2, 110.1
See application file for complete search history.

(56) References Cited

U.S. PATENT DOCUMENTS 7,858,283 B2 12/2010 Ishigami et al.
7,927,775 B2 4/2011 Komatsu et al.
7,939,233 B2 5/2011 Inoue et al.
(Continued)

FOREIGN PATENT DOCUMENTS

JP 2012-194314 10/2012
JP 2013-025289 2/2013
(Continued)

OTHER PUBLICATIONS

U.S. Appl. No. 15/969,318, Tsuneyoshi Tominaga, filed May 2, 2018.
(Continued)

*Primary Examiner* — Janis L Dote
(74) *Attorney, Agent, or Firm* — Venable LLP

(57) ABSTRACT

Provided is a toner, including a toner particle having: a toner base particle containing a binder resin and a colorant; and protrusion derived from a resin fine particle in a surface of the toner base particle, wherein the protrusion is covered with a condensation product of an organosilicon compound represented by the formula (1), and wherein the resin fine particle is in direct contact with the toner base particle.

$$(R^a)_n—Si—(R^b)_{4-n} \quad (1)$$

6 Claims, 2 Drawing Sheets

(56) References Cited

U.S. PATENT DOCUMENTS

| | | | |
|---|---|---|---|
| 8,137,886 | B2 | 3/2012 | Baba et al. |
| 8,142,972 | B2 | 3/2012 | Hotta et al. |
| 8,288,069 | B2 | 10/2012 | Fujikawa et al. |
| 8,574,801 | B2 | 11/2013 | Itabashi et al. |
| 8,609,312 | B2 | 12/2013 | Itabashi et al. |
| 8,642,238 | B2 | 2/2014 | Nozaki et al. |
| 8,828,639 | B2 | 9/2014 | Kamikura et al. |
| 8,986,914 | B2 | 3/2015 | Fujikawa et al. |
| 9,029,056 | B2 | 5/2015 | Kenmoku et al. |
| 9,034,549 | B2 | 5/2015 | Shiotari et al. |
| 9,098,002 | B2 | 8/2015 | Kenmoku et al. |
| 9,098,003 | B2 | 8/2015 | Masumoto et al. |
| 9,256,148 | B2 | 2/2016 | Fujikawa et al. |
| 9,261,806 | B2 | 2/2016 | Moribe et al. |
| 9,285,697 | B2 | 3/2016 | Fukudome et al. |
| 9,298,116 | B2 | 3/2016 | Maetani et al. |
| 9,423,708 | B2 | 8/2016 | Tominaga et al. |
| 9,720,340 | B2 | 8/2017 | Tominaga et al. |
| 9,733,584 | B2 | 8/2017 | Masumoto et al. |
| 9,829,820 | B2 | 11/2017 | Masumoto et al. |
| 9,880,478 | B2 | 1/2018 | Shimano et al. |
| 9,897,932 | B2 | 2/2018 | Hotta et al. |
| 9,897,933 | B2 | 2/2018 | Yoshida et al. |
| 9,921,501 | B2 | 3/2018 | Mochizuki et al. |
| 9,952,523 | B2 | 4/2018 | Shimano et al. |
| 10,338,487 | B2 * | 7/2019 | Kamikura ..... G03G 9/0825 |
| 2009/0246675 | A1 | 10/2009 | Nakamura et al. |
| 2010/0028796 | A1 | 2/2010 | Nakamura et al. |
| 2010/0183971 | A1 | 7/2010 | Fujikawa et al. |
| 2013/0065174 | A1 | 3/2013 | Itabashi et al. |
| 2017/0343913 | A1 * | 11/2017 | Uemura ..... G03G 9/0819 |

FOREIGN PATENT DOCUMENTS

| | | |
|---|---|---|
| JP | 2015-106023 | 6/2015 |
| JP | 2016-011973 | 1/2016 |

OTHER PUBLICATIONS

U.S. Appl. No. 15/973,661, Kenta Kamikura, filed May 8, 2018.
U.S. Appl. No. 15/974,187, Sara Yoshida, filed May 8, 2018.
U.S. Appl. No. 15/974,917, Kunihiko Nakamura, filed May 9, 2018.
U.S. Appl. No. 15/974,928, Fumiya Hatakeyama, filed May 9, 2018.
U.S. Appl. No. 15/974,936, Kenta Kamikura, filed May 9, 2018.
U.S. Appl. No. 15/975,064, Kunihiko Nakamura, filed May 9, 2018.
U.S. Appl. No. 15/975,305, Kentaro Yamawaki, filed May 9, 2018.

* cited by examiner

TONER

BACKGROUND OF THE INVENTION

Field of the Invention

The present invention relates to a toner for developing an electrostatic image (electrostatic latent image) to be used in image forming methods, such as electrophotography and electrostatic printing.

Description of the Related Art

In recent years, along with the development of computers and multimedia, a unit for outputting a full-color image on demand has been desired in a wide variety of fields ranging from an office to a house, and hence an improvement in performance of a copying machine or a printer has been required. Requirements for on-demand printing include an increase in capacity of a toner cartridge and a reduction in amount of toner to be used. In each of the cases, the lengthening of the lifetime of the toner cartridge is needed.

The following condition is required for lengthening the lifetime of the toner cartridge. The properties of the toner are not changed even by multi-sheet printing. In a related-art toner, inorganic fine particles are externally added to the surface of a toner base particle, and hence the inorganic fine particles enter a space between a toner particle and a photosensitive member to reduce a contact area therebetween. However, when the inorganic fine particles are detached by the multi-sheet printing, the toner base particle and the photosensitive member are liable to be brought into direct contact with each other. Accordingly, the contact area between the toner particle and the photosensitive member increases to deteriorate the transferability of the toner in some cases. In order to prevent such deterioration of the transferability, an investigation has been conducted on the suppression of the detachment of the inorganic fine particles not only through the external addition of the inorganic fine particles to the toner base particle but also through the application of heat or mechanical impact.

However, when the detachment of the inorganic fine particles from the toner base particle is suppressed, at the time of the application of a force to the inorganic fine particles, the force is liable to be transmitted as it is to the photosensitive member. Accordingly, an excessively large force is applied to the photosensitive member, and hence the surface layer of the photosensitive member is shaved at the time of the multi-sheet printing in some cases. Accordingly, when the inorganic fine particles are used, it has been difficult to achieve both an improvement in transferability of the toner and the prevention of the shaving of the photosensitive member at the time of the multi-sheet printing.

It is conceivable from the foregoing that when organic fine particles having hardnesses lower than those of the inorganic fine particles are brought into close contact with the surface layer of a toner base body, the shaving of the photosensitive member can be prevented. In, for example, Japanese Patent Application Laid-Open No. 2012-194314, there is a disclosure of a toner having protrusions formed of resin fine particles in the surface layer of a toner base body. In addition, in Japanese Patent Application Laid-Open No. 2015-106023, there is a disclosure of a toner in which after organic fine particles have been caused to adhere to the surface layer of a toner base body, the organic fine particles are fixed with a shell layer containing a thermosetting resin.

However, the transferability of the toner described in Japanese Patent Application Laid-Open No. 2012-194314 is low in some cases, though the stabilization of the chargeability of the toner and the heat-resistant storage stability thereof can be achieved by the resin fine particles. This is probably because the resin fine particles forming the protrusions have so low hardnesses as to be liable to deform, and hence a contact area between a toner particle and a photosensitive member increases. In addition, the toner fuses to a developing member in some cases. This is probably because the resin fine particles have so low hardnesses as to be liable to collapse, and hence the toner is liable to migrate to the developing member with the collapsed resin fine particles as starting points.

In addition, in the toner described in Japanese Patent Application Laid-Open No. 2015-106023, the detachment of the organic fine particles can be prevented by the shell containing the thermosetting resin, but as in the toner described in Japanese Patent Application Laid-Open No. 2012-194314, the transferability of the toner may be low or its fusion to a developing member may occur. A possible cause for the foregoing is as described below. The thermosetting resin is an organic shell layer and hence has a hardness lower than that of an inorganic shell layer formed of a silane coupling agent or the like. The resin fine particles are covered with the organic shell layer having a low hardness, and hence the deformation and collapse of the resin fine particles cannot be sufficiently prevented. As a result, the reduction in transferability or the fusion to the developing member may occur.

The present invention has been made in view of the problems. That is, an object of the present invention is to provide a toner that achieves both high transferability and the prevention of member contamination at the time of multi-sheet printing.

SUMMARY OF THE INVENTION

The present inventors have made extensive investigations, and as a result, have found that the problems can be solved by the following construction.

That is, the present invention relates to a toner, including a toner particle having: a toner base particle containing a binder resin and a colorant; and a protrusion derived from a resin fine particle in a surface of the toner base particle, wherein a surface of the protrusion is covered with a condensation product of an organosilicon compound represented by the following formula (1), and wherein the resin fine particle is in direct contact with the toner base particle:

$$(R^a)_n—Si—(R^b)_{4-n} \quad (1)$$

in the formula (1), $R^a$ represents a halogen atom, a hydroxy group, or an alkoxy group, $R^b$ represents an alkyl group, an alkenyl group, an acetoxy group, an acyl group, an aryl group, an acryloxyalkyl group, or a methacryloxyalkyl group, and n represents an integer of from 2 to 4, provided that when a plurality of $R^a$'s or $R^b$'s exist, the plurality of $R^a$'s or the plurality of $R^b$'s may be identical to or different from each other.

Further features of the present invention will become apparent from the following description of exemplary embodiments with reference to the attached drawings.

DESCRIPTION OF THE EMBODIMENTS

Preferred embodiments of the present invention will now be described in detail in accordance with the accompanying drawings.

An embodiment for carrying out the present invention is described.

The present invention relates to a toner, including a toner particle having: a toner base particle containing a binder resin and a colorant; and a protrusion derived from a resin fine particle in a surface of the toner base particle, wherein a surface of the protrusion is covered with a condensation product of an organosilicon compound represented by the following formula (1), and wherein the resin fine particle is in direct contact with the toner base particle:

$$(R^a)_n—Si—(R^b)_{4-n} \quad (1)$$

in the formula (1), $R^a$ represents a halogen atom, a hydroxy group, or an alkoxy group, $R^b$ represents an alkyl group, an alkenyl group, an acetoxy group, an acyl group, an aryl group, an acryloxyalkyl group, or a methacryloxyalkyl group, and n represents an integer of from 2 to 4, provided that when a plurality of $R^a$'s or $R^b$'s exist, the plurality of $R^a$'s or the plurality of $R^b$'s may be identical to or different from each other.

The outline of the present invention is described below.

Figure 1:
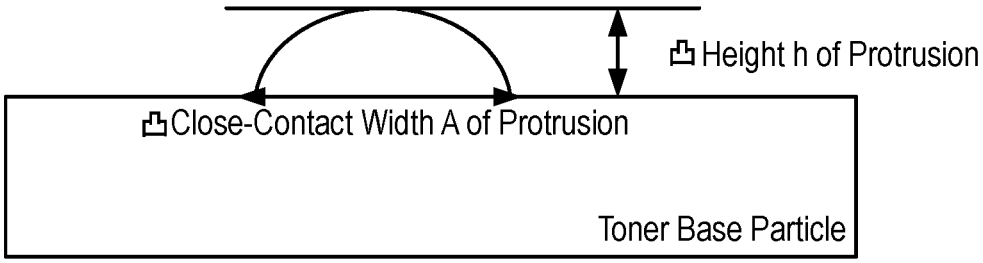
FIG. 1 is an explanatory view of a height h of a protrusion and a close-contact width A of the protrusion.

The phrase "in direct contact" as used in the present invention means that the resin fine particles are in surface contact with the toner base particle. Here, when the height of a protrusion is represented by h and the close-contact width of the protrusion is represented by A, the resin fine particles are preferably in contact with the toner base particle so that the relationship of $0.20 \leq h/A \leq 1.50$, more preferably the relationship of $0.25 \leq h/A \leq 1.00$ may be satisfied from the viewpoints of an improvement in transferability of the toner and the prevention of protrusion detachment (FIG. 1). When the ratio h/A is 0.20 or more, a gap between the toner particle and any other member enlarges, and hence the transferability of the toner is improved. In addition, when the ratio h/A is 1.50 or less, the surfaces of the resin fine particles in close contact with the toner base particle are sufficiently wide, and hence the protrusion detachment hardly occurs even when a force is applied to the protrusions. The ratio h/A can be calculated with a silicon mapping image of the toner particle taken by a method to be described later.

In addition, the "protrusion derived from the resin fine particle" in the present invention can be distinguished from a protrusion derived from the toner base particle by using various analysis approaches after a section of one particle of the toner has been exposed with, for example, a microtome. Specific examples of the analysis approaches include an approach involving performing the distinction based on a difference in contrast shown in a backscattered electron image of a scanning electron microscope, and an approach involving performing the distinction based on a difference in spectrum of electron energy loss spectroscopy (EELS).

In the present invention, the ratio at which the resin fine particles are each in direct contact with the toner base particle is preferably as high as possible. Specifically, in the silicon mapping image of the toner particle taken by the method to be described later, the ratio at which the toner base particle and each of the resin fine particles are in direct contact with each other at an interface therebetween without through the layer of the condensation product of the organosilicon compound is preferably 20% or more when the length of the interface is defined as 100%.

A related-art toner has involved the following problem: in the case where a stress is continuously applied to a toner at the time of multi-sheet printing, when the hardness of a protrusion is low, protrusion collapse occurs, and when the hardness of the protrusion is high, protrusion detachment occurs. The occurrence of the protrusion collapse has been a cause for a reduction in transferability of the toner because a contact area between a toner particle and a photosensitive member increases, or has been a cause for the fusion of the toner particle to a developing member. The protrusion detachment has been a cause for the reduction in transferability because the contact area between the toner particle and the photosensitive member increases, or has been a cause for the fusion of a resin fine particle detached from the toner particle to the developing member.

The present inventors have made extensive investigations, and have found that a toner that achieves both high transferability and the prevention of member contamination at the time of multi-sheet printing can be produced by covering the surface of each of the resin fine particles in direct contact with the toner base particle with the condensation product of the organosilicon compound represented by the formula (1). The present inventors have considered a reason for the foregoing to be as described below.

The protrusions of the toner particle of the present invention each simultaneously have the following two different characteristics: a high hardness of the surface layer of the protrusion based on the condensation product of the organosilicon compound; and a low hardness of the inside of the protrusion based on the resin fine particle. Further, the resin fine particles are in direct contact with the toner base particle, and hence the resin fine particles and the toner base particle are integrated with each other. The present inventors have considered that accordingly, protrusion collapse is prevented by the high hardness of the surface layer of the protrusion, and at the same time, protrusion detachment is prevented by the low hardness of the inside of the protrusion because a force from the outside is absorbed and the force is released to the toner base particle with which the resin fine particles are integrated. The present inventors have considered that as a result of the foregoing, the toner of the present invention prevents the fusion of the toner particle to a developing member due to the protrusion collapse or the fusion of a resin fine particle thereto due to the protrusion detachment even at the time of the multi-sheet printing.

In addition, the protrusions of the toner of the present invention in contact with a photosensitive member are considered to be substantially free from deforming in a transfer step because the protrusions are each covered with the condensation product of the organosilicon compound. The present inventors have considered that accordingly, the toner particle and the photosensitive member are brought into point contact with each other by the protrusions that have entered a space between the toner base particle and the photosensitive member, and hence the high transferability of the toner can be achieved. In view of the foregoing, the present inventors have considered that the toner that achieves both the high transferability and the prevention of member contamination at the time of the multi-sheet printing can be produced by covering the surface of each of the protrusions derived from the resin fine particles with the condensation product of the organosilicon compound.

Details about the organosilicon compound and the resin fine particles to be used in the present invention are described below.

(Organosilicon Compound)

The content of the condensation product of the organosilicon compound in the resin fine particles is preferably 0.1 part by mass or more and 20.0 parts by mass or less with respect to 100.0 parts by mass of the toner base particle. In addition, the content is more preferably 0.3 part by mass or more and 15.0 parts by mass or less, still more preferably 0.5 part by mass or more and 10.0 parts by mass or less. When the content of the condensation product of the organosilicon compound is 0.1 part by mass or more, the condensation product of the organosilicon compound moderately covers the surface layer of each of the protrusions derived from the resin fine particles, and hence the deformation of the protrusions hardly occurs in the transfer step. In addition, when the content of the condensation product of the organosilicon compound is 20.0 parts by mass or less, the protrusions moderately deform at the time of a development step to absorb a force. Accordingly, the force to be transmitted to a photosensitive member reduces and hence the shaving of the photosensitive member is suppressed.

The surface of each of the protrusions derived from the resin fine particles is covered with the condensation product of the organosilicon compound represented by the formula (1). Two or more kinds of organosilicon compounds may be used as the organosilicon compound to form a condensation product as long as the compounds are each represented by the formula (1).

Examples of the compound represented by the formula (1) serving as the organosilicon compound include difunctional, trifunctional, and tetrafunctional organosilicon compounds. Of those, a difunctional or trifunctional organosilicon compound (n in the formula (1) represents 2 or 3) is particularly preferably used because the protrusions moderately deform in the development step to suppress the shaving of the photosensitive member.

Examples of the difunctional organosilicon compound include dimethyldimethoxysilane and dimethyldiethoxysilane.

Examples of the trifunctional organosilicon compound include: trifunctional alkyl group-containing silane compounds, such as methyltrimethoxysilane, methyltriethoxysilane, methyldiethoxymethoxysilane, methylethoxydimethoxysilane, ethyltrimethoxysilane, ethyltriethoxysilane, propyltrimethoxysilane, propyltriethoxysilane, butyltrimethoxysilane, butyltriethoxysilane, hexyltrimethoxysilane, hexyltriethoxysilane, octyltrimethoxysilane, octyltriethoxysilane, octadecyltrimethoxysilane, and octadecyltriethoxysilane; trifunctional alkenyl group-containing silane compounds, such as vinyltrimethoxysilane, vinyltriethoxysilane, allyltrimethoxysilane, and allyltriethoxysilane; trifunctional aryl group-containing silane compounds, such as phenyltrimethoxysilane and phenyltriethoxysilane; trifunctional acryloxyalkyl group-containing silane compounds, such as γ-acryloxypropyltrimethoxysilane, γ-acryloxypropyltriethoxysilane, γ-acryloxypropyldiethoxymethoxysilane, and γ-acryloxypropylethoxydimethoxysilane; and trifunctional methacryloxyalkyl group-containing silane compounds, such as γ-methacryloxypropyltrimethoxysilane, γ-methacryloxypropyltriethoxysilane, γ-methacryloxypropyldiethoxymethoxysilane, and γ-methacryloxypropylethoxydimethoxysilane.

Examples of the tetrafunctional organosilicon compound include tetramethoxysilane, tetraethoxysilane, tetrapropoxysilane, and tetrabutoxysilane.

In addition, in the present invention, two or more kinds of organosilicon compounds may be used in combination. The combined use of the organosilicon compounds can impart different functions based on the respective organosilicon compounds to the toner particle. The organosilicon compounds to be used in combination may each be an organosilicon compound represented by the formula (1), or may each be an organosilicon compound except the foregoing. Examples of the organosilicon compound except the organosilicon compound represented by the formula (1) include various monofunctional organosilicon compounds. Examples of the monofunctional organosilicon compounds include trimethylethoxysilane, triethylmethoxysilane, triethylethoxysilane, triisobutylmethoxysilane, triisopropylmethoxysilane, and tri(2-ethylhexyl)methoxysilane.

(Resin Fine Particles)

The number-average particle diameter of the resin fine particles is preferably 10 nm or more and 500 nm or less, more preferably 15 nm or more and 300 nm or less. When the number-average particle diameter of the resin fine particles is 10 nm or more, a gap is formed between a member, such as a photosensitive drum or an intermediate transfer belt, and the toner particle, and hence the member is hardly brought into direct contact with the toner base particle. Thus, a contact area between the toner particle and the member reduces, and hence the transferability of the toner is improved. In addition, when the number-average particle diameter of the resin fine particles is 500 nm or less, the protrusions derived from the resin fine particles are not excessively high, and hence protrusion detachment is alleviated.

In addition, the kinds of the resin fine particles in the present invention are not particularly limited, but the resin fine particles are preferably thermoplastic fine particles. When the thermoplastic fine particles are used, the protrusions derived from the resin fine particles are more hardly detached from the toner base particle. This is probably because the resin fine particles that are thermoplastic are easily integrated with the toner base particle that is also thermoplastic. Further, the use of the thermoplastic fine particles improves the fixability of the toner. This is probably because a thermoplastic resin forming the resin fine particles easily melts at the time of the fixation of the toner.

Examples of the thermoplastic fine particles include a vinyl-based resin, a polyester resin, a polyamide resin, and a fluorine resin. As the vinyl-based resin, there may be used, for example, a polymer or a copolymer of a monomer such as ethylene, propylene, isobutylene, styrene, or α-methylstyrene; an unsaturated carboxylic acid ester, such as methyl acrylate, butyl acrylate, methyl methacrylate, 2-hydroxyethyl methacrylate, t-butyl methacrylate, or 2-ethylhexyl methacrylate; an unsaturated carboxylic acid, such as acrylic acid or methacrylic acid; an unsaturated dicarboxylic acid, such as maleic acid; an unsaturated dicarboxylic acid anhydride, such as maleic anhydride; a nitrile-based vinyl monomer, such as acrylonitrile; a halogen-containing vinyl monomer, such as vinyl chloride; or a nitro-based vinyl monomer, such as nitrostyrene.

In addition, the glass transition temperature (Tg) of the resin fine particles in the present invention is preferably 40° C. or more and 110° C. or less, more preferably 50° C. or more and 100° C. or less, still more preferably 60° C. or more and 95° C. or less. When the Tg of the resin fine particles is 40° C. or more, the protrusions derived from the resin fine particles hardly collapse, and hence the fusion of the resin forming the resin fine particles to a member hardly occurs. In addition, when the Tg of the resin fine particles is 110° C. or less, the toner base particle and the resin fine particles are more easily integrated with each other, and hence the protrusions derived from the resin fine particles are hardly detached from the toner base particle. Further, when the Tg of the resin fine particles is 110° C. or less, the resin fine particles easily deform at the time of the application of heat in a fixation step, and hence the fixation temperature of the toner can be reduced.

Further, the peak top molecular weight Mp of the resin fine particles in the present invention is preferably 3,000 or more and 50,000 or less. When the Mp of the resin fine particles is 3,000 or more, the protrusions derived from the resin fine particles hardly collapse, and hence the fusion of the resin to a member hardly occurs. In addition, when the Mp of the resin fine particles is 50,000 or less, the toner base particle and the resin fine particles are more easily integrated with each other, and hence the protrusions derived from the resin fine particles are hardly detached from the toner base particle.

Further, the resin fine particles in the present invention each preferably contain a resin having an ionic functional group. The use of the resin fine particles each containing the resin having an ionic functional group in the toner particle according to the present invention improves the charge rising performance of the toner. The present inventors have considered a reason for the foregoing to be as described below.

A toner having satisfactory charge rising performance means such a toner that when the toner and a charging member are brought into contact with each other, the charge quantity of the toner is saturated within a short time period. In order to saturate the charge quantity within a short time period, charge needs to easily transfer from the protrusions of the surface layer of the toner particle in contact with the charging member to the entirety of the surface layer of the same toner particle. In the present invention, the protrusions of the surface layer of the toner particle in contact with the charging member and the toner base particle are each covered with the condensate of the organosilicon compound. Accordingly, a contact area between the protrusions and the toner base particle increases, and hence the charge easily transfers. Further, the use of the resin having an ionic functional group facilitates the transfer of the charge also on the surface layers of the resin fine particles, and hence enables the charge to rapidly transfer to the entirety of the surface layer of the same toner particle. The present inventors have considered that the charge rising performance is improved because of the foregoing.

Examples of the ionic functional group include a sulfo group, an amino group, a carboxy group, and a phenolic hydroxy group. Examples of the resin containing an ionic functional group include: resins such as a polyester resin, a melamine resin, a guanamine resin, a urea resin, and an aniline resin; and resins each obtained by polymerization or copolymerization of a monomer such as acrylic acid, methacrylic acid, vinylsalicylic acid, phthalic acid 1-vinyl ester, vinylbenzoic acid, 1-vinylnaphthalene-2-carboxylic acid, 2-acrylamido-2-methylpropanesulfonic acid, sodium p-styrenesulfonate, potassium p-styrenesulfonate, lithium p-styrenesulfonate, or a p-styrenesulfonic acid ester, such as a p-styrenesulfonic acid ethyl ester.

The content of the resin fine particles with respect to the toner base particle is preferably 0.1 part by mass or more and 15.0 parts by mass or less with respect to 100.0 parts by mass of the toner base particle from the viewpoint of the transferability of the toner. The content is more preferably 0.3 part by mass or more and 10.0 parts by mass or less, still more preferably 0.5 part by mass or more and 7.0 parts by mass or less. When the content of the resin fine particles is 0.1 part by mass or more, a member, such as a photosensitive drum or an intermediate transfer belt, is hardly brought into direct contact with the toner base particle. Accordingly, a contact area therebetween reduces and hence the transferability is improved. In addition, when the content of the resin fine particles is 15.0 parts by mass or less, the number of the resin fine particles in contact with the member is suppressed. Accordingly, a contact area between the member and the resin fine particles reduces, and hence the transferability is improved.

Next, a method of producing the toner particle according to the present invention is described. However, the present invention is not limited thereto.

The toner particle according to the present invention is preferably produced by a method involving: first producing the resin fine particles and the toner base particle separately from each other; bringing the produced resin fine particles into close contact with the toner base particle; and then covering the toner base particle with the condensation product of the organosilicon compound. Details about a method of producing the toner particle according to the present invention based on the method are described below.

(Method of Producing Resin Fine Particles)

Any method may be used as a method of producing resin fine particles. For example, known methods, such as an emulsion polymerization method, a soap-free emulsion polymerization method, a phase inversion emulsification method, and a mechanical emulsification method, can be used. Of those production methods, a phase inversion emulsification method is preferred because an emulsifier and a dispersion stabilizer are not required, and resin fine particles each having a smaller particle diameter can be obtained easily.

In the phase inversion emulsification method, when the resin is dissolved in an organic solvent, and a neutralizing agent is added to the solution, followed by mixing with an aqueous medium with stirring, the solution of the resin is subjected to phase inversion emulsification to generate resin fine particles. The organic solvent is removed by a method such as heating or reduction in pressure after the phase inversion emulsification. Thus, according to the phase inversion emulsification method, a stable aqueous dispersion of resin fine particles can be obtained substantially without using an emulsifier or a dispersion stabilizer.

In the phase inversion emulsification method, a resin having self-dispersibility or a resin that can express self-dispersibility through neutralization is used. Here, the self-dispersibility of the resin in the aqueous medium is exhibited in a resin having a hydrophilic group in a molecule thereof. Specifically, a resin having a polyether group or an ionic functional group is preferred.

(Method of Producing Toner Base Particle)

A method of producing the toner base particle is not particularly limited, and is, for example, a suspension polymerization method, a dissolution suspension method, an emulsion aggregation method, or a pulverization method. When the toner base particle is produced in the aqueous medium, the toner base particle may be used as it is in the next step (a step of bringing the resin fine particles into close contact with the toner base particle), or the toner base particle may be redispersed in the aqueous medium after having been washed, filtered, and dried. When the toner base particle is produced by a dry process, the toner base particle may be dispersed in the aqueous medium by a known method. In order to disperse the toner base particle in the aqueous medium, the aqueous medium preferably contains a dispersion stabilizer.

When the toner base particle is obtained, a polymerizable monomer composition is prepared by: adding a polymerizable monomer and various materials (e.g., a colorant, a wax, a charge control agent, and a polar resin); and melting, dissolving, or dispersing the materials with a dispersing machine. At this time, a wax, a charge control agent, a solvent for viscosity adjustment, a crystalline resin, a chain transfer agent, or any other additive can be appropriately added to the polymerizable monomer composition as required. Examples of the dispersing machine include a homogenizer, a ball mill, a colloid mill, and an ultrasonic dispersing machine.

Next, the polymerizable monomer composition is loaded into an aqueous medium containing poorly water-soluble inorganic fine particles prepared in advance, and a suspension is prepared by dispersing the mixture with a high-speed dispersing machine, such as a high-speed stirring machine or an ultrasonic dispersing machine (granulation step). Examples of the poorly water-soluble inorganic fine particles include: hydroxyapatite; phosphates, such as tribasic calcium phosphate, dibasic calcium phosphate, magnesium phosphate, aluminum phosphate, and zinc phosphate; carbonates, such as calcium carbonate and magnesium carbonate; metal hydroxides, such as calcium hydroxide, magnesium hydroxide, and aluminum hydroxide; sulfates, such as calcium sulfate and barium sulfate; calcium metasilicate; bentonite; silica; and alumina.

After that, the polymerizable monomer in the suspension is polymerized to produce the binder resin (polymerization step).

A polymerization initiator may be mixed together with any other additive at the time of the preparation of the polymerizable monomer composition, or may be mixed into the polymerizable monomer composition immediately before being suspended in the aqueous medium. In addition, during the granulation or after the completion of the granulation, that is, immediately before the initiation of the polymerization reaction, the initiator can be added in a state of being dissolved in the polymerizable monomer or any other solvent as required. After the polymerizable monomer has been polymerized to produce the binder resin, desolvation treatment is performed as required. Thus, an aqueous dispersion liquid of the toner base particle is formed.

In addition, the glass transition temperature (Tg) of the toner base particle is preferably 40° C. or more and 75° C. or less, more preferably 40° C. or more and 65° C. or less. In addition, the peak top molecular weight (Mp) of the toner base particle in a molecular weight distribution measured by gel permeation chromatography (GPC) is preferably 5,000 or more and 50,000 or less.

(Method of Bringing Resin Fine Particles into Close Contact with Toner Baser Particle)

In the present invention, a method of bringing the resin fine particles into direct contact with the toner base particle is not particularly limited. The resin fine particles may be added to a toner base particle-dispersed liquid and then buried in the toner base particle with mechanical force of impact, or the resin fine particles may be brought into close contact with the toner base particle by heating the aqueous medium. Alternatively, the resin fine particles may be brought into close contact with the toner base particle by adding an aggregating agent, or the above-mentioned procedures may be combined. In any case, it is preferred that the aqueous medium having dispersed therein the resin fine particles and the toner base particles be stirred.

From the viewpoint of increasing the contact area between the resin fine particles and the toner base particle, a procedure for heating the aqueous medium to at least a glass transition temperature of the toner base particle is more preferred. Through setting of the aqueous medium to the above-mentioned temperature, the toner base particle is softened, and hence the resin fine particles are easily brought into close contact with the toner base particle.

The resin fine particles and the toner base particle are preferably brought into close contact with each other by adjusting, under a state in which the resin fine particles and the toner base particle are caused to coexist in the aqueous medium, the pH of the aqueous medium to such a pH that the resin fine particles are easily dispersed in the aqueous medium, followed by heating. According to the method, the resin fine particles can be brought into direct contact with the toner base particle in a state of being dispersed, and the aggregation of the toner base particles hardly occurs.

(Method of Covering Toner Base Particle)

A method of covering the toner base particle in close contact with the protrusions derived from the resin fine particles with the condensate of the organosilicon compound is described below. However, the covering method is not limited thereto.

A preferred production method for the condensate is a method involving: preparing a mixed solution containing, in the aqueous medium, the organosilicon compound represented by the formula (1) or a hydrolysate thereof, and the toner base particle in close contact with the protrusions derived from the resin fine particles; and then condensing the organosilicon compound.

The organosilicon compound may be added to and mixed in the aqueous medium by any method. For example, the organosilicon compound may be added as it is. In addition, the organosilicon compound may be added after having been mixed with the aqueous medium to be hydrolyzed.

In addition, a reaction of the organosilicon compound is known to have pH dependence, and hence the pH of the aqueous medium is preferably adjusted to 7.0 or more and 12.0 or less during the progress of the condensation.

The pH of the aqueous medium or the mixed solution only needs to be adjusted with an existing acid or base. Examples of the acid for adjusting the pH include: hydrochloric acid, bromic acid, iodic acid, perchloric acid, perbromic acid, metaperiodic acid, permanganic acid, thiocyanic acid, sulfuric acid, nitric acid, phosphonic acid, phosphoric acid, diphosphoric acid, hexafluorophosphoric acid, tetrafluoroboric acid, tripolyphosphoric acid, aspartic acid, o-aminobenzoic acid, p-aminobenzoic acid, isonicotinic acid, oxaloacetic acid, citric acid, 2-glycerophosphoric acid, glutamic acid, cyanoacetic acid, oxalic acid, trichloroacetic acid, o-nitrobenzoic acid, nitroacetic acid, picric acid, picolinic acid, pyruvic acid, fumaric acid, fluoroacetic acid, bromoacetic acid, o-bromobenzoic acid, maleic acid, and malonic acid.

Examples of the base for adjusting the pH include: hydroxides of alkali metals, such as potassium hydroxide, sodium hydroxide, and lithium hydroxide, and aqueous solutions thereof, carbonates of alkali metals, such as potassium carbonate, sodium carbonate, and lithium carbonate, and aqueous solutions thereof, sulfates of alkali metals, such as potassium sulfate, sodium sulfate, and lithium sulfate, and aqueous solutions thereof; phosphates of alkali metals, such as potassium phosphate, sodium phosphate, and lithium phosphate, and aqueous solutions thereof, hydroxides of alkaline earth metals, such as calcium hydroxide and magnesium hydroxide, and aqueous solutions thereof, ammonia; basic amino acids, such as histidine, arginine, and lysine, and aqueous solutions thereof; and trishydroxymethylaminomethane.

Preferred examples of the aqueous medium in the present invention include water, alcohols, such as methanol, ethanol, and propanol, and mixed solvents thereof.

The colorant, the binder resin, the wax, and the charge control agent to be incorporated into the toner base particle/the toner particle, and inorganic fine particles to be externally added are described below.

(Colorant)

Conventionally known pigments and dyes corresponding to the respective black, yellow, magenta, and cyan colors, and other colors, magnetic materials, and the like can each be used as the colorant to be incorporated into the toner base particle without any particular limitation.

Examples of the yellow pigment include: a monoazo compound; a disazo compound; a condensed azo compound; an isoindolinone compound; an isoindoline compound; a benzimidazolone compound; an anthraquinone compound; an azo metal complex; a methine compound; and an arylamide compound. A specific example thereof is C.I. Pigment Yellow 74, 93, 95, 109, 111, 128, 155, 174, 180, or 185.

Examples of the magenta pigment include: a monoazo compound; a condensed azo compound; a diketopyrrolopyrrole compound; an anthraquinone compound; a quinacridone compound; a basic dye lake compound; a naphthol compound; a benzimidazolone compound; a thioindigo compound; and a perylene compound. Specific examples thereof include: C.I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 238, 254, or 269; and C.I. Pigment Violet 19.

Examples of the cyan pigment include: a copper phthalocyanine compound and a derivative thereof; an anthraquinone compound; and a basic dye lake compound. A specific example thereof is C.I. Pigment Blue 1, 7, 15, 15:1, 15:2, 15:3, 15:4, 60, 62, or 66.

Examples of the black pigment include carbon black, aniline black, non-magnetic ferrite, and magnetite. In addition, a pigment toned to a black color with the yellow pigment, the magenta pigment, and the cyan pigment may be used.

Further, a magnetic material can be incorporated into the toner base particle of the present invention to turn the toner base particle into a magnetic toner base particle. In this case, the magnetic material can also serve as a colorant. Examples of the magnetic material include: an iron oxide typified by magnetite, hematite, or ferrite; a metal typified by iron, cobalt, or nickel, or an alloy formed of any such metal and a metal such as aluminum, cobalt, copper, lead, magnesium, tin, zinc, antimony, beryllium, bismuth, cadmium, calcium, manganese, selenium, titanium, tungsten, or vanadium; and mixtures thereof.

Those pigments may be used alone or as a mixture, and may each be used in the state of a solid solution. In addition, various dyes conventionally known as colorants may be used in combination with the pigments.

The content of the pigment is preferably 1.0 part by mass or more and 20.0 parts by mass or less with respect to 100.0 parts by mass of the binder resin.

(Binder Resin)

The toner base particle contains the binder resin. Examples of the binder resin to be used in the present invention include a vinyl-based resin, a polyester resin, a polyamide resin, a furan resin, an epoxy resin, a xylene resin, and a silicone resin. Of those, a vinyl-based resin is preferably used. A polymer or a copolymer of such a monomer as described below can be used as the vinyl-based resin: a styrene-based monomer, such as styrene or α-methylstyrene; an unsaturated carboxylate, such as methyl acrylate, butyl acrylate, methyl methacrylate, 2-hydroxyethyl methacrylate, t-butyl methacrylate, or 2-ethylhexyl methacrylate; an unsaturated carboxylic acid, such as acrylic acid or methacrylic acid; an unsaturated dicarboxylic acid, such as maleic acid; an unsaturated dicarboxylic acid anhydride, such as maleic anhydride; a nitrile-based vinyl monomer, such as acrylonitrile; a halogen-containing vinyl monomer, such as vinyl chloride; or a nitro-based vinyl monomer, such as nitrostyrene. Of those, a copolymer of a styrene-based monomer and an unsaturated carboxylate is preferably used.

(Wax)

The toner base particle may contain the wax. Examples of the wax to be used in the present invention include:

an ester of a monohydric alcohol and an aliphatic monocarboxylic acid, or an ester of a monovalent carboxylic acid and an aliphatic monoalcohol, such as behenyl behenate, stearyl stearate, or palmityl palmitate; an ester of a dihydric alcohol and an aliphatic monocarboxylic acid, or an ester of a divalent carboxylic acid and an aliphatic monoalcohol, such as dibehenyl sebacate or hexanediol dibehenate; an ester of a trihydric alcohol and an aliphatic monocarboxylic acid, or an ester of a trivalent carboxylic acid and an aliphatic monoalcohol, such as glycerin tribehenate; an ester of a tetrahydric alcohol and an aliphatic monocarboxylic acid, or an ester of a tetravalent carboxylic acid and an aliphatic monoalcohol, such as pentaerythritol tetrastearate or pentaerythritol tetrapalmitate; an ester of a hexahydric alcohol and an aliphatic monocarboxylic acid, or an ester of a hexavalent carboxylic acid and an aliphatic monoalcohol, such as dipentaerythritol hexastearate or dipentaerythritol hexapalmitate; an ester of a polyhydric alcohol and an aliphatic monocarboxylic acid, or an ester of a polyvalent carboxylic acid and an aliphatic monoalcohol, such as polyglycerin behenate; a natural ester wax, such as a carnauba wax or a rice bran wax; a petroleum-based wax or a derivative thereof, such as a paraffin wax, a microcrystalline wax, or petrolatum; a hydrocarbon wax or a derivative thereof produced by a Fischer-Tropsch method; a polyolefin wax or a derivative thereof, such as a polyethylene wax or a polypropylene wax; a higher aliphatic alcohol; a fatty acid, such as stearic acid or palmitic acid; and an acid amide wax.

(Charge Control Agent)

The toner base particle may further contain the charge control agent. A conventionally known charge control agent can be used as the charge control agent without any particular limitation. Specific examples thereof include negative charge control agents including: a metal complex of an aromatic carboxylic acid typified by salicylic acid, an alkyl salicylic acid, a dialkyl salicylic acid, naphthoic acid, and a dicarboxylic acid; a polymer or a copolymer having a sulfonic acid group, a sulfonic acid salt group, or a sulfonic acid ester group; a metal salt or a metal complex of an azo dye or an azo pigment; a boron compound; a silicon compound; and calixarene. The examples also include positive charge control agents including a quaternary ammonium salt, a polymer-type compound having a quaternary ammonium salt in a side chain, a guanidine compound, a nigrosine-based compound, and an imidazole compound. As the polymer or copolymer having a sulfonic acid group, a sulfonic acid salt group, or a sulfonic acid ester group, there may be used, for example: a homopolymer of a sulfonic acid group-containing vinyl-based monomer typified by styrenesulfonic acid, 2-acrylamido-2-methylpropanesulfonic acid, 2-methacrylamido-2-methylpropanesulfonic acid, vinylsulfonic acid, acrylsulfonic acid, or methacrylsulfonic acid; or a copolymer of the vinyl-based monomer shown in the "Binder Resin" section and the sulfonic acid group-containing vinyl-based monomer.

The addition amount of the charge control agent is preferably 0.01 part by mass or more and 20.0 parts by mass or less with respect to 100.0 parts by mass of the binder resin.

(Inorganic Fine Particles)

The toner of the present invention may be used as a toner in the form of a toner particle in which the toner base particle and the resin fine particles in direct contact with its surface are each covered with the condensation product of the organosilicon compound, or a product obtained by externally adding various inorganic fine particles to the toner particle as required may be used as the toner. For example, the following materials are used as the inorganic fine particles:

silica, titanium oxide, carbon black, and carbon fluoride, metal oxides (e.g., strontium titanate, cerium oxide, alumina, magnesium oxide, and chromium oxide), nitrides (e.g., silicon nitride), metal salts (e.g., calcium sulfate, barium sulfate, and calcium carbonate), and fatty acid metal salts (e.g., zinc stearate and calcium stearate).

The inorganic particles may also be subjected to hydrophobic treatment in order to improve the flowability of the toner and to uniformize the charging of the toner particles. As a treatment agent for hydrophobic treatment of the inorganic particles, there are given an unmodified silicone varnish, various modified silicone varnishes, an unmodified silicone oil, various modified silicone oils, a silane compound, a silane coupling agent, any other organosilicon compound, and an organotitanium compound. Those treatment agents may be used alone or in combination thereof.

Measurement methods for physical property values specified in the present invention are described below.

<Particle Diameter of Toner Base Particle>

The number-average particle diameter (D1) and the weight-average particle diameter (D4) of the toner base particles are calculated as described below. A precision particle size distribution measuring apparatus based on a pore electrical resistance method provided with a 100 μm aperture tube "Coulter Counter Multisizer 3" (manufactured by Beckman Coulter, Inc.) is used as a measuring apparatus. Dedicated software included therewith "Beckman Coulter Multisizer 3 Version 3.51" (manufactured by Beckman Coulter, Inc.) is used for setting measurement conditions and analyzing measurement data. The measurement is performed with the number of effective measurement channels of 25,000.

An electrolyte aqueous solution prepared by dissolving reagent grade sodium chloride in ion-exchanged water so as to have a concentration of 1%, for example, "ISOTON II" (manufactured by Beckman Coulter, Inc.) can be used in the measurement.

The dedicated software is set as described below prior to the measurement and the analysis.

In the "Change Standard Operating Method (SOMME)" screen of the dedicated software, the total count number of a control mode is set to 50,000 particles, the number of times of measurement is set to 1, and a value obtained by using "standard particles each having a particle diameter of 10.0 μm" (manufactured by Beckman Coulter, Inc.) is set as a Kd value. A threshold and a noise level are automatically set by pressing a "Threshold/Measure Noise Level button". In addition, a current is set to 1,600 μA, a gain is set to 2, and an electrolyte solution is set to ISOTON II, and a check mark is placed in a check box "Flush Aperture Tube after Each Run."

In the "Convert Pulses to Size Settings" screen of the dedicated software, a bin spacing is set to a logarithmic particle diameter, the number of particle diameter bins is set to 256, and a particle diameter range is set to the range of from 2 μm to 60 μm.

A specific measurement method is as described below.

(1) 200 mL of the electrolyte aqueous solution is charged into a 250-milliliter round-bottom beaker made of glass dedicated for Multisizer 3. The beaker is set in a sample stand, and the electrolyte aqueous solution in the beaker is stirred with a stirrer rod at 24 rotations/sec in a counterclockwise direction. Then, dirt and bubbles in the aperture tube are removed by the "Flush Aperture" function of the dedicated software.

(2) 30 mL of the electrolyte aqueous solution is charged into a 100-milliliter flat-bottom beaker made of glass. 0.3 mL of a diluted solution obtained by diluting "Contaminon N" (10% aqueous solution of a neutral detergent for washing a precision measuring unit formed of a nonionic surfactant, an anionic surfactant, and an organic builder, and having a pH of 7, manufactured by Wako Pure Chemical Industries, Ltd.) with ion-exchanged water by three fold in terms of a mass ratio is added as a dispersant to the electrolyte aqueous solution.

(3) An ultrasonic dispersing unit "Ultrasonic Dispension System Tetra 150" (manufactured by Nikkaki Bios Co., Ltd.) in which two oscillators each having an oscillatory frequency of 50 kHz are built so as to be out of phase by 180°, and which has an electrical output of 120 W is prepared. 3.3 L of ion-exchanged water is charged into the water tank of the ultrasonic dispersing unit. 2 mL of the Contaminon N is charged into the water tank.

(4) The beaker in the section (2) is set in the beaker fixing hole of the ultrasonic dispersing unit, and the ultrasonic dispersing unit is operated. Then, the height position of the beaker is adjusted in order that the liquid level of the electrolyte aqueous solution in the beaker may resonate with an ultrasonic wave from the ultrasonic dispersing unit to the fullest extent possible.

(5) 10 mg of the toner base particles are gradually added to and dispersed in the electrolyte aqueous solution in the beaker in the section (4) under a state in which the electrolyte aqueous solution is irradiated with the ultrasonic wave. Then, the ultrasonic dispersion treatment is continued for an additional 60 seconds. The temperature of water in the water tank is appropriately adjusted so as to be 10° C. or more and 40° C. or less in the ultrasonic dispersion.

(6) The electrolyte aqueous solution in the section (5) in which the toner base particles have been dispersed is dropped with a pipette to the round-bottom beaker in the section (1) placed in the sample stand, and the concentration of the toner base particles to be measured is adjusted to 5%. Then, measurement is performed until the particle diameters of 50,000 particles are measured.

(7) The measurement data is analyzed with the dedicated software included with the apparatus, and the number-average particle diameter (D1) and the weight-average particle diameter (D4) are calculated.

<Particle Diameter of Resin Fine Particles>

The number-average particle diameter of the resin fine particles is calculated by measuring a particle diameter by dynamic light scattering (DLS) through use of Zetasizer Nano-ZS (manufactured by Malvern Instruments Ltd.).

First, a power source of an apparatus is turned on and kept in this state for 30 minutes until a laser becomes stable.

Then, Zetasizer software is activated. Manual is selected from a Measure menu, and the detail of the measurement is input as described below.

Measurement mode: particle diameter

Material: Polystyrene latex (RI: 1.59, Absorption: 0.01)

Dispersant: Water (Temperature: 25° C., Viscosity: 0.8872 cP, RI: 1.330)

Temperature: 25.0° C.

Cell: Clear disposable zeta cell

Measurement duration: Automatic

A sample is prepared by diluting the resin fine particles with water so that the sample may have a concentration of 0.50 mass %, and is filled into a disposable cell. The cell is loaded into a cell holder of the apparatus.

When the above-mentioned preparation is finished, a Start button on a measurement display screen is pressed to perform measurement.

The number-average particle diameter is calculated based on data on a particle size distribution on a number basis, which is obtained by converting a light intensity distribution obtained from DLS measurement by the Mie theory.

<Glass Transition Temperature (Tg) of Resin Fine Particles>

The glass transition temperature (Tg) of the resin fine particles is measured with a differential scanning calorimeter "Q2000" (manufactured by TA Instruments) in conformity with ASTM D3418-82. The melting points of indium and zinc are used in the temperature correction of the detecting portion of the apparatus, and the heat of fusion of indium is used in the correction of a heat quantity. Specifically, 3 mg of the resin fine particles are precisely weighed and loaded into an aluminum pan. An empty aluminum pan is used as a reference. The measurement is performed in the measurement temperature range of from 30° C. to 200° C. at a preset rate of temperature increase of 10° C./min. A change in specific heat of the resin fine particles is obtained in the temperature increase process. The glass transition temperature (Tg) of the resin fine particles is defined as the temperature of the point at which a straight line equidistant in a vertical axis direction from straight lines obtained by extending respective baselines before and after the obtainment of the change in specific heat of a reversible specific heat change curve, and the curve of a portion where the glass transition temperature changes in a stepwise manner intersect each other.

<Peak Top Molecular Weight (Mp) of Resin Fine Particles>

The peak top molecular weight (Mp) of the resin fine particles is measured by gel permeation chromatography (GPC) as described below.

First, the resin fine particles are dissolved in tetrahydrofuran at room temperature over 24 hours. Then, the resultant solution is filtered with a solvent-resistant membrane filter "MYSYORI DISC" (manufactured by Tosoh Corporation) having a pore diameter of 0.2 μm to provide a sample solution. The sample solution is adjusted so that the concentration of components soluble in tetrahydrofuran may be 0.5 mass %. The measurement is performed by using the sample solution under the following conditions.

Apparatus: HLC-8120 GPC (detector: RI) (manufactured by Tosoh Corporation)

Column: seven columns Shodex KF-801, 802, 803, 804, 805, 806, and 807 (manufactured by Showa Denko K.K.) connected in series Eluent: tetrahydrofuran Flow rate: 1.0 mL/min Oven temperature: 40.0° C.

Sample injection amount: 0.10 mL

At the time of the calculation of the molecular weight of the sample, a molecular weight calibration curve produced by using a standard polystyrene resin (e.g., a resin available under the product name "TSK STANDARD POLYSTYRENE F-850, F-450, F-288, F-128, F-80, F-40, F-20, F-10, F-4, F-2, F-1, A-5000, A-2500, A-1000, or A-500" from Tosoh Corporation) is used.

<Observation of Surface of Toner Particle>

The surface of the toner particle is observed as described below. Liquid nitrogen is poured into an anti-contamination trap attached to the housing of a scanning electron microscope (SEM, apparatus name: S-4800, manufactured by Hitachi, Ltd.) until the liquid overflows, and the trap is left for 30 minutes. The "PC-SEM" of the S-4800 is activated to perform flushing (the cleaning of a FE chip serving as an electron source). The acceleration voltage display portion of a control panel on a screen is clicked, and a [Flushing] button is pressed to open a flushing execution dialog. After it has been confirmed that a flushing intensity is 2, the flushing is executed. It is confirmed that an emission current by the flushing is from 20 A to 40 A. A sample holder having fixed thereto the toner particle is inserted into the sample chamber of the housing of the S-4800. [Origin] on the control panel is pressed to move the sample holder to an observation position.

The acceleration voltage display portion is clicked to open a HV setting dialog, and an acceleration voltage and the emission current are set to [2.0 kV] and [10 μA], respectively. In the [Basic] tab of an operation panel, signal selection is placed in [SE], and the mode of a SE detector is set to "Mix."

Similarly, in the [Basic] tab of the operation panel, the probe current, focus mode, and WD of an electron optical system condition block are set to [Normal], [UHR], and [3.0 mm], respectively. The [ON] button of the acceleration voltage display portion of the control panel is pressed to apply the acceleration voltage.

<Observation of Condensation Product of Organosilicon Compound>

The mapping of the condensation product of the organosilicon compound is performed as described below. First, the toner is sufficiently dispersed in a normal temperature-curable epoxy resin, and then the resultant is cured under an atmosphere at 40° C. for 2 days. A flaky sample having a thickness of 40 nm is cut out of the resultant cured product with a microtome including a diamond blade. After that, a sectional layer of one particle of the toner is observed with a transmission electron microscope (TEM, apparatus name: JEM-2800, manufactured by JEOL Ltd.) at an enlargement magnification of from 10,000 to 100,000. Here, silicon atom mapping is performed by utilizing energy-dispersive X-ray spectroscopy (EDX). In the present invention, a place where a silicon atom was present was defined as a place where the condensation product of the organosilicon compound was present.

Figure 2:
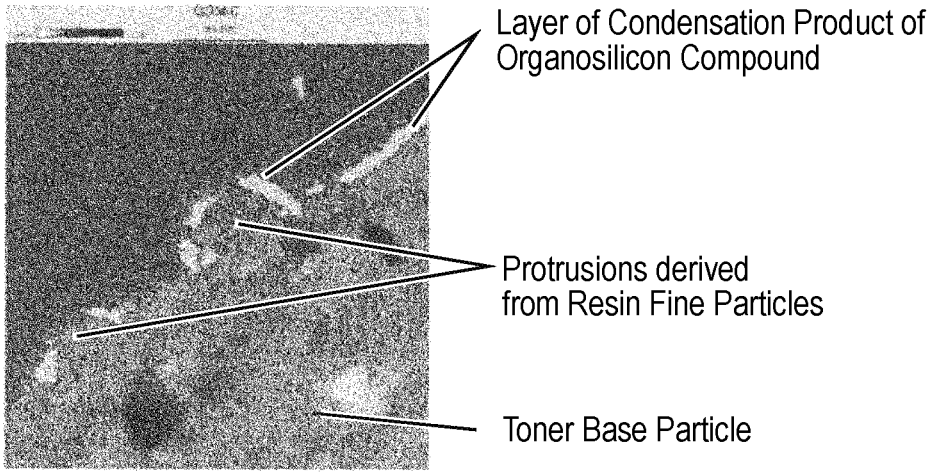
FIG. 2 is a view for illustrating an example of a silicon mapping image of one particle of a toner according to the present invention taken with a transmission electron microscope (TEM).

It was confirmed from the resultant silicon mapping image of the TEM image of the particle of the toner that the layer of the condensation product of the organosilicon compound was formed on the surface of each of the protrusions. In addition, it was confirmed that the ratio at which the toner base particle and each of the resin fine particles were in direct contact with each other at an interface therebetween without through the layer of the condensation product of the organosilicon compound was 20% or more when the length of the interface was defined as 100%. An example in which the toner base particle and the resin fine particles are observed is illustrated in FIG. 2 (a whitely mapped portion represents the layer of the condensation product of the organosilicon compound). In FIG. 2, the organosilicon compound is not observed at the interface of the surface of each of the resin fine particles on a side embedded in the toner base particle, and hence the ratio at which the toner base particle and the resin fine particle are in direct contact with each other at the interface therebetween is substantially 100% of the length of the interface.

<Calculation of Ratio h/A of Toner Particles>

The ratio h/A of the toner particle is calculated as described below. A sectional layer of the toner particle is observed by the above-mentioned method. At this time, the height h of an arbitrary protrusion and the close-contact width A of the protrusion are measured, and the ratio h/A of each fine particle is calculated. The ratios h/A are calculated for a total of 100 protrusions, and the average of the calculated values is defined as the ratio h/A of the toner particle.

In the present invention, the protrusions derived from the resin fine particles are formed by bringing the resin fine particles into close contact with the surface layer of the toner base particle, and are each covered with the condensation product of the organosilicon compound. Thus, there can be provided a toner that achieves both high transferability and the prevention of member contamination at the time of multi-sheet printing.

The present invention is specifically described below by way of Examples. However, the present invention is not limited to these Examples. All of "part(s)" of materials in Examples and Comparative Examples are by mass, unless otherwise stated.

<Production of Aqueous Dispersion of Resin Fine Particles 1>

The following materials were dissolved in 42.0 parts of N,N-dimethylformamide, and the solution was stirred for 1 hour while nitrogen bubbling was performed. After that, the solution was heated to 110° C. to produce a mixed solution.

| | |
|---|---|
| Styrene | 59.5 parts |
| n-Butyl acrylate | 7.7 parts |
| Methacrylic acid | 2.8 parts |

A mixed solution of 2.1 parts of tert-butyl peroxy isopropyl monocarbonate (product name: PERBUTYL I, manufactured by Nippon Oil & Fats Co., Ltd.) serving as an initiator and 37.0 parts of toluene was dropped into the mixed solution. The resultant mixed liquid was held at 110° C. for 4 hours. After that, the resultant reaction product was cooled and dropped into 1,000.0 parts of methanol. Thus, a precipitate was obtained. The resultant precipitate was dissolved in 120.0 parts of tetrahydrofuran, and then the solution was dropped into 1,800.0 parts of methanol to precipitate a white precipitate. The resultant white precipitate was filtered, and was dried under reduced pressure at 90° C. to provide a resin 1.

200.0 Parts of methyl ethyl ketone was loaded into a reaction vessel including a stirring machine, a condenser, a temperature gauge, and a nitrogen-introducing tube, and 100.0 parts of the resin 1 was added to the methyl ethyl ketone to be dissolved therein. Next, 28.5 parts of a 1.0 mol/L aqueous solution of potassium hydroxide was slowly added to the solution, and the mixture was stirred for 10 minutes. After that, 500.0 parts of ion-exchanged water was slowly dropped into the mixture to be emulsified therein.

The resultant emulsified product was distilled under reduced pressure to be desolvated, and ion-exchanged water was added to adjust the resin concentration of the desolvated product to 10%. Thus, an aqueous dispersion of resin fine particles 1 was obtained.

<Production of Aqueous Dispersions of Resin Fine Particles 2 to 11>

Aqueous dispersions of resin fine particles 2 to 11 were each produced under the same conditions as those of the aqueous dispersion of the resin fine particles 1 except that the amounts of various reagents were changed as shown in Table 1.

TABLE 1

| | St/parts | BA/parts | MMA/parts | MAA/parts | 4-VSA/parts | KOH/parts |
|---|---|---|---|---|---|---|
| Resin fine particles 1 | 59.5 | 7.7 | 0.0 | 2.8 | 0.0 | 28.5 |
| Resin fine particles 2 | 63.3 | 4.9 | 0.0 | 0.0 | 5.6 | 28.5 |
| Resin fine particles 3 | 59.5 | 7.7 | 0.0 | 2.8 | 0.0 | 52.4 |
| Resin fine particles 4 | 59.5 | 7.7 | 0.0 | 2.8 | 0.0 | 47.6 |
| Resin fine particles 5 | 59.5 | 7.7 | 0.0 | 2.8 | 0.0 | 43.8 |
| Resin fine particles 6 | 59.5 | 7.7 | 0.0 | 2.8 | 0.0 | 37.9 |
| Resin fine particles 7 | 59.5 | 7.7 | 0.0 | 2.8 | 0.0 | 23.7 |
| Resin fine particles 8 | 59.5 | 7.7 | 0.0 | 2.8 | 0.0 | 18.4 |
| Resin fine particles 9 | 59.5 | 7.7 | 0.0 | 2.8 | 0.0 | 12.3 |
| Resin fine particles 10 | 67.2 | 0.0 | 0.0 | 0.0 | 5.6 | 28.5 |
| Resin fine particles 11 | 0.0 | 0.0 | 67.2 | 0.0 | 5.6 | 28.5 |

In Table 1, St represents styrene, BA represents n-butyl acrylate, MMA represents methyl methacrylate, MAA represents methacrylic acid, 4-VSA represents 4-vinylsalicylic acid, and KOH represents the 1.0 mol/L aqueous solution of potassium hydroxide.

<Production of Aqueous Dispersion of Resin Fine Particles 12>

A temperature in a reaction vessel containing 100.0 parts of 2-butanone and 50.0 parts of methanol was set to 60° C. while nitrogen bubbling was performed. After that, the following mixed solutions were simultaneously dropped from different vessels into the reaction vessel over 60 minutes.

| 2-Acrylamido-2-methylpropanesulfonic acid mixed solution | |
|---|---|
| 2-Acrylamido-2-methylpropanesulfonic acid | 9.0 parts |
| Styrene | 79.3 parts |
| n-Butyl acrylate | 10.3 parts |
| 2-Butanone | 100.0 parts |
| Methanol | 50.0 parts |
| Dimethyl-2,2'-azobis(2-methyl propionate) | 1.0 part |
| **4-Vinylpyridine-containing mixed solution** | |
| 4-Vinylpyridine | 1.9 parts |
| 2-Butanone | 50.0 parts |

After the dropping, the mixture was stirred at 60° C. for 8 hours, and was cooled to room temperature to provide a polymer-containing composition. The resultant polymer-containing composition was dropped into 1,400.0 parts of methanol to provide a precipitate. The resultant precipitate was washed with 200 parts of methanol twice, and was then dried under reduced pressure at 90° C. to provide a resin 12.

200 Parts of methyl ethyl ketone was loaded into a reaction vessel including a stirring machine, a condenser, a temperature gauge, and a nitrogen-introducing tube, and 100.0 parts of the resin 12 was added to the methyl ethyl ketone to be dissolved therein. Then, 28.5 parts of a 1.0 mol/L aqueous solution of potassium hydroxide was slowly added to the solution, and the mixture was stirred for 10 minutes. After that, 500.0 parts of ion-exchanged water was slowly dropped into the mixture to provide an emulsified product.

The resultant emulsified product was distilled under reduced pressure to be desolvated, and ion-exchanged water was added to adjust the resin concentration of the desolvated product to 10%. Thus, an aqueous dispersion of resin fine particles 12 was obtained.

<Production of Aqueous Dispersion of Resin Fine Particles 13>

An aqueous dispersion of resin fine particles 13 was obtained under the same conditions as those of the aqueous dispersion of the resin fine particles 12 except that the composition of the 2-acrylamido-2-methylpropanesulfonic acid mixed solution and the addition amount of the 1.0 mol/L aqueous solution of potassium hydroxide were changed as described below.

| 2-Acrylamido-2-methylpropanesulfonic acid mixed solution: | |
|---|---|
| 2-Acrylamido-2-methylpropanesulfonic acid | 4.7 parts |
| Styrene | 83.1 parts |
| n-Butyl acrylate | 10.8 parts |
| 2-Butanone | 100.0 parts |
| Methanol | 50.0 parts |
| Dimethyl-2,2'-azobis(2-methyl propionate) | 1.0 part |
| 1.0 mol/L aqueous solution of potassium hydroxide | 14.2 parts |

<Production of Aqueous Dispersion of Resin Fine Particles 14>

The following materials were weighed in a reaction vessel including a stirring machine, a condenser, a temperature gauge, and a nitrogen-introducing tube, and were mixed and dissolved.

| | |
|---|---|
| Styrene | 87.3 parts |
| n-Butyl acrylate | 11.3 parts |
| Hexanediol acrylate | 0.4 part |
| n-Lauryl mercaptan | 3.2 parts |

A 10% aqueous solution of NEOGEN RK (manufactured by DKS Co., Ltd.) was added to and dispersed in the solution.

Further, an aqueous solution obtained by dissolving 0.15 part of potassium persulfate in 10.0 parts of ion-exchanged water was added to the resultant while the resultant was slowly stirred for 10 minutes. After the vessel had been purged with nitrogen, the mixture was subjected to emulsion polymerization at a temperature of 70° C. for 6.0 hours.

After the completion of the polymerization, the reaction liquid was cooled to room temperature, and ion-exchanged water was added to adjust its resin concentration to 10%. Thus, an aqueous dispersion of resin fine particles 14 was obtained.

<Production of Aqueous Dispersion of Resin Fine Particles 15>

The following materials were weighed in a reaction vessel including a stirring machine, a condenser, a temperature gauge, and a nitrogen-introducing tube, and were subjected to an esterification reaction at 190° C.

| | |
|---|---|
| Propylene oxide-modified bisphenol A (2 mol adduct) | 20.0 parts |
| Propylene oxide-modified bisphenol A (3 mol adduct) | 80.0 parts |
| Terephthalic acid | 20.0 parts |
| Isophthalic acid | 20.0 parts |
| Tetrabutoxytitanium | 0.3 part |

After that, the temperature was increased to 220° C. and a pressure in the system was gradually reduced, followed by a polycondensation reaction at 150 Pa. Thus, a resin 15 was obtained.

500.0 Parts of ion-exchanged water was added to 200.0 parts of the resultant resin 15, and the mixture was heated to 95° C. and melted under a warm bath. After that, while the molten product was sufficiently stirred with a homogenizer (manufactured by IKA: ULTRA-TURRAX T50) at 7,800 rpm, a 0.1 mol/L aqueous solution of sodium hydrogen carbonate was added to set its pH to 7.0. The pH was identified with a pH meter (D-74: manufactured by Horiba, Ltd.) mounted with an electrode (9615S-10D: manufactured by Horiba, Ltd.). Further, a mixed solution of 3 parts by mass of sodium dodecylbenzenesulfonate and 297.0 parts by mass of ion-exchanged water was gradually dropped into the mixture to be emulsified and dispersed therein. After that, ion-exchanged water was added to adjust the resin concentration of the resultant to 10%. Thus, an aqueous dispersion of resin fine particles 15 was obtained.

The following pH measurement was performed with the pH meter and the electrode described above.

<Production of Aqueous Dispersions of Resin Fine Particles 16 to 21>

Aqueous dispersions of resin fine particles 16 to 21 were each obtained under the same conditions as those in the production of the aqueous dispersion of the resin fine particles 15 except that a polymerization time and the pressure were arbitrarily changed.

The number-average particle diameter, peak top molecular weight Mp, and glass transition temperature Tg of each of the resin fine particles 1 to 21 produced as described above were measured. The results are summarized in Table 2.

TABLE 2

| | Particle diameter/nm | Tg/° C. | Mp |
|---|---|---|---|
| Resin fine particles 1 | 102 | 82 | 15,142 |
| Resin fine particles 2 | 103 | 89 | 15,039 |
| Resin fine particles 3 | 11 | 80 | 15,088 |
| Resin fine particles 4 | 17 | 82 | 14,976 |
| Resin fine particles 5 | 30 | 81 | 15,085 |
| Resin fine particles 6 | 52 | 80 | 15,011 |
| Resin fine particles 7 | 208 | 80 | 15,071 |
| Resin fine particles 8 | 304 | 82 | 14,985 |
| Resin fine particles 9 | 507 | 80 | 15,099 |
| Resin fine particles 10 | 98 | 98 | 15,015 |
| Resin fine particles 11 | 103 | 107 | 14,978 |
| Resin fine particles 12 | 202 | 74 | 15,139 |
| Resin fine particles 13 | 204 | 75 | 15,045 |
| Resin fine particles 14 | 198 | 74 | 15,057 |
| Resin fine particles 15 | 99 | 70 | 14,976 |
| Resin fine particles 16 | 101 | 42 | 1,978 |
| Resin fine particles 17 | 100 | 51 | 2,993 |
| Resin fine particles 18 | 100 | 60 | 5,021 |
| Resin fine particles 19 | 102 | 73 | 31,238 |

TABLE 2-continued

| | Particle diameter/nm | Tg/° C. | Mp |
|---|---|---|---|
| Resin fine particles 20 | 101 | 82 | 50,819 |
| Resin fine particles 21 | 100 | 91 | 81,983 |
| Resin fine particles 22 | 96 | — | — |
| Resin fine particles 23 | 106 | — | — |

<Production of Aqueous Dispersion of Resin Fine Particles 22>

A 10% aqueous solution of EPOSTAR MX (MX050W manufactured by Nippon Shokubai Co., Ltd.) was produced to provide an aqueous dispersion of resin fine particles 22. The number-average particle diameter of the resin fine particles 22 is shown in Table 2, but a Tg evaluation could not be performed because the resin fine particles 22 showed no change in specific heat in the range of from 30° C. to 200° C. In addition, a sample solution for an Mp evaluation could not be produced because substantially no dissolution of the resin fine particles 22 in tetrahydrofuran occurred. Accordingly, an Mp evaluation could not be performed. The molecular weight of each of the resin fine particles 22 is considered to be 50,000 or more because the resin fine particles are each a thermosetting resin.

<Production of Aqueous Dispersion of Resin Fine Particles 23>

A 10% aqueous solution of EPOSTAR MX (MX100W manufactured by Nippon Shokubai Co., Ltd.) was produced to provide an aqueous dispersion of resin fine particles 23. The number-average particle diameter of the resin fine particles 23 is shown in Table 2, but a Tg evaluation could not be performed because the resin fine particles 23 showed no change in specific heat in the range of from 30° C. to 200° C. In addition, a sample solution for an Mp evaluation could not be produced because substantially no dissolution of the resin fine particles 23 in tetrahydrofuran occurred. Accordingly, an Mp evaluation could not be performed. The molecular weight of each of the resin fine particles 23 is considered to be 50,000 or more because the resin fine particles are each a thermosetting resin.

<Preparation of Organosilicon Compound Liquid 1>

| | |
|---|---|
| Ion-exchanged water | 90.0 parts |
| Methyltrimethoxysilane (silicon compound) | 10.0 parts |

The above-mentioned materials were mixed, and diluted hydrochloric acid was added to adjust the pH of the mixture to 4.0. After that, the resultant was stirred for 1 hour while being heated to 60° C. in a water bath. Thus, an organosilicon compound liquid 1 was prepared.

<Preparation of Organosilicon Compound Liquids 2 to 10>

Organosilicon compound liquids 2 to 10 were each prepared in the same manner as in the preparation of the organosilicon compound liquid 1 except that the kind of the organosilicon compound was changed as shown in Table 3.

TABLE 3

| | Organosilicon compound |
|---|---|
| Organosilicon compound liquid 1 | Methyltrimethoxysilane |
| Organosilicon compound liquid 2 | Methyltriethoxysilane |
| Organosilicon compound liquid 3 | Ethyltrimethoxysilane |
| Organosilicon compound liquid 4 | Vinyltrimethoxysilane |
| Organosilicon compound liquid 5 | Vinyltriethoxysilane |
| Organosilicon compound liquid 6 | Propyltrimethoxysilane |
| Organosilicon compound liquid 7 | Methacryloxypropyltrimethoxysilane |
| Organosilicon compound liquid 8 | Hexyltrimethoxysilane |
| Organosilicon compound liquid 9 | Octadecyltrimethoxysilane |
| Organosilicon compound liquid 10 | Dimethyldimethoxysilane |

<Method of Producing Toner Base Particle-dispersed Liquid 1>

14.0 Parts of sodium phosphate (dodecahydrate) (manufactured by Rasa Industries, Ltd.) was loaded into 390.0 parts of ion-exchanged water in a reaction vessel, and the temperature of the mixture was held at 65° C. for 1.0 hour while the reaction vessel was purged with nitrogen.

While the mixture was stirred with T.K. Homomixer (manufactured by Tokushu Kika Kogyo Co., Ltd.) at 12,000 rpm, an aqueous solution of calcium chloride obtained by dissolving 9.2 parts of calcium chloride (dihydrate) in 10.0 parts of ion-exchanged water was collectively loaded into the reaction vessel. Thus, an aqueous medium containing a dispersion stabilizer was prepared. Further, diluted hydrochloric acid was loaded into the aqueous medium in the reaction vessel to adjust its pH to 6.0. Thus, an aqueous medium 1 was prepared.

(Preparation of Polymerizable Monomer Composition)

| | |
|---|---|
| Styrene | 60.0 parts |
| C.I. Pigment Blue 15:3 | 6.5 parts |

The above-mentioned materials were loaded into an attritor (manufactured by Nippon Coke & Engineering Co., Ltd.), and were dispersed with zirconia particles each having a diameter of 1.7 mm at 220 rpm for 5.0 hours to prepare a pigment-dispersed liquid. Next, the following materials were added to the pigment-dispersed liquid.

| | |
|---|---|
| Styrene | 10.0 parts |
| n-Butyl acrylate | 30.0 parts |
| Polyester resin (terephthalic acid-propylene oxide-modified bisphenol A copolymer) | 5.0 parts |
| Fischer-Tropsch wax (melting point: 70° C.) | 7.0 parts |

The temperature of the above-mentioned materials was kept at 65° C., and the materials were uniformly dissolved and dispersed with T.K. Homomixer at 500 rpm. Thus, a polymerizable monomer composition was prepared.

(Granulation Step)

While the temperature of the aqueous medium 1 was kept at 70° C. and the number of revolutions of a high-speed stirring apparatus was kept at 12,000 rpm, the polymerizable monomer composition was loaded into the aqueous medium 1, and 9.0 parts of t-butyl peroxypivalate serving as a polymerization initiator was added to the mixture. The resultant was granulated as it was with the stirring apparatus for 10 minutes while the number of revolutions was maintained at 12,000 rpm.

(Polymerization Step)

The stirring machine was changed from the high-speed stirring apparatus to a propeller stirring blade, and the granulated product was held at 70° C. and polymerized for 5.0 hours while being stirred at 150 rpm. A polymerization reaction was performed by increasing the temperature to 85°

C. and heating the resultant at the temperature for 2.0 hours. Ion-exchanged water was added to adjust the concentration of toner base particles in the resultant dispersion liquid to 20.0 mass %. Thus, a toner base particle-dispersed liquid 1 was obtained. The number-average particle diameter (D1) of the toner base particles 1 was 5.9 μm, and the weight-average particle diameter (D4) thereof was 6.5 μm.

<Method of Producing Toner Base Particle-dispersed Liquid 2>

The following materials were mixed in a reaction tank including a cooling tube, a stirring machine, and a nitrogen-introducing tube.

| | |
|---|---|
| Terephthalic acid | 29.0 parts |
| Polyoxypropylene(2.2)-2,2-bis(4-hydroxyphenyl)propane | 80.0 parts |
| Titanium dihydroxybis(triethanol aminate) | 0.1 part |

After that, the mixture was heated to 200° C., and was subjected to a reaction for 9 hours while nitrogen was introduced into the tank and water to be produced was removed. Further, 5.8 parts of trimellitic anhydride was added to the resultant, and the mixture was heated to 170° C. and subjected to a reaction for 3 hours to synthesize a polyester resin.

Next, the following materials were loaded into an autoclave, and the system was purged with nitrogen. After that, while the mixture was increased in temperature and stirred, its temperature was held at 180° C.

| | |
|---|---|
| Low-density polyethylene (melting point: 100° C.) | 20.0 parts |
| Styrene | 64.0 parts |
| n-Butyl acrylate | 13.5 parts |
| Acrylonitrile | 2.5 parts |

Subsequently, 50.0 parts of a 2.0 mass % solution of t-butyl hydroperoxide in xylene was continuously dropped into the system for 4.5 hours, and the resultant mixture was cooled. After that, the solvent was separated and removed. Thus, a graft polymer in which a styrene-acrylic copolymer was grafted to the polyethylene was obtained.

The following materials were sufficiently mixed with Mitsui Henschel Mixer (manufactured by Mitsui Miike Chemical Engineering Machinery Co., Ltd.), and then the mixture was melted and kneaded with a biaxial kneader (manufactured by Ikegai Iron Works, Ltd.) whose temperature had been set to 100° C.

| | |
|---|---|
| Polyester resin | 100.0 parts |
| Fischer-Tropsch wax (melting point: 70° C.) | 5.0 parts |
| Graft polymer | 5.0 parts |
| C.I. Pigment Blue 15:3 | 5.0 parts |

The resultant kneaded product was cooled and coarsely pulverized to 1 mm or less with a hammer mill to provide a coarsely pulverized product. Next, the resultant coarsely pulverized product was finely pulverized with Turbo Mill manufactured by Turbo Kogyo Co., Ltd. to provide a finely pulverized product having a size of about 5 μm. After that, fine and coarse powders were further cut with a multi-division classifier utilizing a Coanda effect. Thus, toner base particles 2 were obtained. The toner base particles 2 had a number-average particle diameter (D1) of 5.6 μm and a weight-average particle diameter (D4) of 6.5 μm.

14.0 Parts of sodium phosphate (dodecahydrate) (manufactured by Rasa Industries, Ltd.) was loaded into 390.0 parts of ion-exchanged water in a reaction vessel, and the temperature of the mixture was held at 65° C. for 1.0 hour while the vessel was purged with nitrogen.

While the mixture was stirred with T.K. Homomixer at 12,000 rpm, an aqueous solution of calcium chloride obtained by dissolving 9.2 parts of calcium chloride (dihydrate) in 10.0 parts of ion-exchanged water was collectively loaded into the reaction vessel. Thus, an aqueous medium containing a dispersion stabilizer was prepared. Further, diluted hydrochloric acid was loaded into the aqueous medium in the reaction vessel to adjust its pH to 6.0. Thus, an aqueous medium was prepared.

200.0 Parts of the toner base particles were loaded into the aqueous medium, and were dispersed therein at a temperature of 60° C. for 15 minutes while being rotated with T.K. Homomixer at 5,000 rpm. Ion-exchanged water was added to adjust the concentration of the toner base particles in the resultant dispersion liquid to 20.0 mass %. Thus, a toner base particle-dispersed liquid 2 was obtained.

<Method of Producing Toner Base Particle-dispersed Liquid 3>

The following materials were weighed, and were mixed and dissolved.

| | |
|---|---|
| Styrene | 82.6 parts |
| n-Butyl acrylate | 9.2 parts |
| Acrylic acid | 1.3 parts |
| Hexanediol acrylate | 0.4 part |
| n-Lauryl mercaptan | 3.2 parts |

A 10% aqueous solution of NEOGEN RK (manufactured by DKS Co., Ltd.) was added to and dispersed in the solution. Further, while the resultant was slowly stirred for 10 minutes, an aqueous solution obtained by dissolving 0.15 part of potassium persulfate in 10.0 parts of ion-exchanged water was added thereto. After purging with nitrogen, the mixture was subjected to emulsion polymerization at a temperature of 70° C. for 6.0 hours. After the completion of the polymerization, the reaction liquid was cooled to room temperature, and ion-exchanged water was added thereto. Thus, a resin particle-dispersed liquid having a solid content concentration of 12.5% and a number-average particle diameter of 0.2 μm was obtained.

The following materials were weighed and mixed.

| | |
|---|---|
| Ester wax (melting point: 70° C.) | 100.0 parts |
| NEOGEN RK | 15.0 parts |
| Ion-exchanged water | 385.0 parts |

The mixture was dispersed with a wet jet mill JN100 (manufactured by Jokoh Co., Ltd.) for 1 hour to provide a wax-dispersed liquid. The solid content concentration of the wax particle-dispersed liquid was 20.0%.

The following materials were weighed and mixed.

| | |
|---|---|
| C.I. Pigment Blue 15:3 | 100.0 parts |
| NEOGEN RK | 15.0 parts |
| Ion-exchanged water | 885.0 parts |

The mixture was dispersed with a wet jet mill JN100 for 1 hour to provide a colorant-dispersed liquid. The solid content concentration of the colorant-dispersed liquid was 10.0%.

| | |
|---|---|
| Resin particle-dispersed liquid | 160.0 parts |
| Wax-dispersed liquid | 10.0 parts |
| Colorant-dispersed liquid | 10.0 parts |
| Magnesium sulfate | 0.2 part |

The above-mentioned materials were dispersed with a homogenizer (manufactured by IKA), and then the resultant was warmed to 65° C. while being stirred. The resultant was stirred at 65° C. for 1.0 hour, and was then observed with an optical microscope. As a result, it was confirmed that aggregate particles having a number-average particle diameter of 6.0 μm were formed. 2.2 Parts of NEOGEN RK (manufactured by DKS Co., Ltd.) was added to the resultant, and then the temperature of the mixture was increased to 80° C., followed by stirring for 2.0 hours. Thus, a fused toner particle precursor was obtained.

The mixture containing the toner base particles was cooled and then filtered. A solid separated by the filtration was washed with 720.0 parts of ion-exchanged water under stirring for 1.0 hour. The dispersion liquid containing the toner particle precursor was filtered and dried to provide toner base particles 3. The number-average particle diameter (D1) of the toner base particles 3 was 6.2 μm, and the weight-average particle diameter (D4) thereof was 7.1 μm.

14.0 Parts of sodium phosphate (dodecahydrate) (manufactured by Rasa Industries, Ltd.) was loaded into 390.0 parts of ion-exchanged water in a vessel, and the temperature of the mixture was held at 65° C. for 1.0 hour while the vessel was purged with nitrogen.

While the mixture was stirred with T.K. Homomixer at 12,000 rpm, an aqueous solution of calcium chloride obtained by dissolving 9.2 parts of calcium chloride (dihydrate) in 10.0 parts of ion-exchanged water was collectively loaded into the mixture. Thus, an aqueous medium containing a dispersion stabilizer was prepared. Further, diluted hydrochloric acid was loaded into the aqueous medium to adjust its pH to 6.0. Thus, an aqueous medium was prepared.

100.0 Parts of the toner base particles 3 were loaded into the aqueous medium, and were dispersed at a temperature of 60° C. for 15 minutes while being rotated with T.K. Homomixer at 5,000 rpm. Ion-exchanged water was added to adjust the solid content concentration of the toner base particles 3 in the resultant dispersion liquid to 20.0%. Thus, a toner base particle-dispersed liquid 3 was obtained.

<Method of Producing Toner Base Particle-dispersed Liquid 4>

660.0 Parts of ion-exchanged water and 25.0 parts of a 48.5% aqueous solution of sodium dodecyl diphenyl ether disulfonate were mixed and stirred, and the mixture was stirred with T.K. Homomixer at 10,000 rpm to prepare an aqueous medium.

The following materials were loaded into 500.0 parts of ethyl acetate, and were dissolved with a propeller-type stirring apparatus at 100 rpm to prepare a dissolved liquid.

| | |
|---|---|
| Styrene/butyl acrylate copolymer (copolymerization ratio: 80/20) | 100.0 parts |
| Polyester resin (terephthalic acid-propylene oxide-modified bisphenol A copolymer) | 3.0 parts |
| C.I. Pigment Blue 15:3 | 6.5 parts |
| Fischer-Tropsch wax (melting point: 70° C.) | 9.0 parts |

Next, 150.0 parts of the aqueous medium was loaded into a vessel, and was stirred with T.K. Homomixer at a number of revolutions of 12,000 rpm. 100.0 Parts of the dissolved liquid was added to the aqueous medium, and the contents were mixed for 10 minutes to prepare an emulsified slurry.

After that, 100.0 parts of the emulsified slurry was loaded into a flask having set therein a tube for degassing, a stirring machine, and a temperature gauge. While being stirred at a stirring peripheral speed of 20 m/min, the slurry was desolvated at 30° C. for 12 hours under reduced pressure, and was aged at 45° C. for 4 hours to provide a desolvated slurry. After the desolvated slurry had been filtered under reduced pressure, 300.0 parts of ion-exchanged water was added to the resultant filter cake, and the contents were mixed and redispersed with T.K. Homomixer (at a number of revolutions of 12,000 rpm for 10 minutes), followed by filtration.

The resultant filter cake was dried with a dryer at 45° C. for 48 hours, and was sieved with a mesh having an aperture of 75 μm to provide toner base particles 4. The number-average particle diameter (D1) of the toner base particles 4 was 5.7 μm, and the weight-average particle diameter (D4) thereof was 6.9 μm.

14.0 Parts of sodium phosphate (dodecahydrate) (manufactured by Rasa Industries, Ltd.) was loaded into 390.0 parts of ion-exchanged water in a vessel, and the temperature of the mixture was held at 65° C. for 1.0 hour while the vessel was purged with nitrogen.

While the mixture was stirred with T.K. Homomixer at 12,000 rpm, an aqueous solution of calcium chloride obtained by dissolving 9.2 parts of calcium chloride (dihydrate) in 10.0 parts of ion-exchanged water was collectively loaded into the mixture. Thus, an aqueous medium containing a dispersion stabilizer was prepared. Further, diluted hydrochloric acid was loaded into the aqueous medium to adjust its pH to 6.0. Thus, an aqueous medium was prepared.

100.0 Parts of the toner base particles 4 were loaded into the aqueous medium, and were dispersed at a temperature of 60° C. for 15 minutes while being rotated with T.K. Homomixer at 5,000 rpm. Ion-exchanged water was added to adjust the solid content concentration of the toner base particles 4 in the resultant dispersion liquid to 20.0%. Thus, a toner base particle-dispersed liquid 4 was obtained.

<Method of Producing Toner 1>

The following samples were weighed in a reaction vessel, and were mixed with a propeller stirring blade.

| | |
|---|---|
| Resin fine particle-dispersed liquid 1 | 20.0 parts |
| Toner base particle-dispersed liquid 1 | 500.0 parts |

Next, diluted hydrochloric acid was added to adjust the pH of the mixed solution to 5.5. After the temperature of the mixed solution had been set to 70° C., the mixed solution was held for 1 hour while being stirred with a propeller stirring blade.

After that, 60.0 parts of the organosilicon compound liquid 1 was added to the mixed solution, and the pH of the whole was adjusted to 9.0 with a 1.0 mol/L aqueous solution of NaOH. Further, the resultant was held for 4 hours while being stirred, followed by air-cooling to a temperature of 25° C.

Diluted hydrochloric acid was added to the resultant mixed solution to adjust its pH to 1.5, and then the whole was stirred for 2 hours, followed by filtration, water washing, and drying. Thus, toner particles 1 having protrusions derived from the resin fine particles on their surfaces were obtained. The toner particles were defined as a toner 1.

<Methods of Producing Toners 2 and 4 to 32>

Toners 2 and 4 to 32 were each obtained in the same manner as in the method of producing the toner 1 except that the kinds and amounts of the organosilicon compound liquid and the resin fine particle-dispersed liquid, and the kind of the toner base particle-dispersed liquid were changed as shown in Table 4.

<Method of Producing Toner 3>

Toner particles 3 were obtained by changing the kinds and amounts of the organosilicon compound liquid and the resin fine particle-dispersed liquid, and the kind of the toner base particle-dispersed liquid as shown in Table 4. 0.5 Part of silica particles having a number-average particle diameter of 50 nm, which had been treated with hexamethyldisilazane, were added to the toner particles 3, and the mixture was stirred with a fluidized bed mixer (Mitsui Henschel Mixer, manufactured by Mitsui Miike Chemical Engineering Machinery Co., Ltd.) for 5 minutes to provide a toner 3.

<State of Close Contact of Resin Fine Particles with Toner Base Particle>

Sections of each one particle of toners was observed with a transmission electron microscope, and a portion where a toner base particle and resin fine particles were in contact with each other was observed. Then, in each of the toner particles 1 to 32, it was confirmed from the silicon mapping image of the TEM image of each one particle of the toner that the layer of the condensation product of the organosilicon compound was formed on the surface of each of the protrusions, and that the ratio at which the toner base particle and each of the resin fine particles were in direct contact with each other at an interface therebetween without through the layer of the condensation product of the organosilicon compound was 20% or more.

Subsequently, the ratios h/A of the toner particles were calculated by the above-mentioned method. The results are shown in Table 4. In each of the toner particles 1 to 32, the ratio h/A fell within the range of from 0.2 to 1.5, and hence the resin fine particles were in direct contact with the toner base particle.

TABLE 4

| | Organosilicon compound liquid | | Fine particle-dispersed liquid | | Toner base | |
|---|---|---|---|---|---|---|
| | Kind | Parts | Kind | Parts | particle-dispersed liquid | h/A |
| Toner 1 | Organosilicon compound liquid 1 | 60.0 | Resin fine particle-dispersed liquid 1 | 20.0 | Toner base particle-dispersed liquid 1 | 0.52 |
| Toner 2 | Organosilicon compound liquid 2 | 60.0 | Resin fine particle-dispersed liquid 1 | 20.0 | Toner base particle-dispersed liquid 1 | 0.57 |
| Toner 3 | Organosilicon compound liquid 2 | 60.0 | Resin fine particle-dispersed liquid 1 | 20.0 | Toner base particle-dispersed liquid 1 | 0.50 |
| Toner 4 | Organosilicon compound liquid 2 | 50.0 | Resin fine particle-dispersed liquid 1 | 20.0 | Toner base particle-dispersed liquid 2 | 0.49 |
| Toner 5 | Organosilicon compound liquid 2 | 70.0 | Resin fine particle-dispersed liquid 1 | 20.0 | Toner base particle-dispersed liquid 3 | 0.55 |
| Toner 6 | Organosilicon compound liquid 2 | 80.0 | Resin fine particle-dispersed liquid 1 | 20.0 | Toner base particle-dispersed liquid 4 | 0.49 |
| Toner 7 | Organosilicon compound liquid 3 | 60.0 | Resin fine particle-dispersed liquid 1 | 20.0 | Toner base particle-dispersed liquid 1 | 0.53 |
| Toner 8 | Organosilicon compound liquid 4 | 60.0 | Resin fine particle-dispersed liquid 12 | 20.0 | Toner base particle-dispersed liquid 1 | 0.47 |
| Toner 9 | Organosilicon compound liquid 5<br>Organosilicon compound liquid 10 | 30.0<br>30.0 | Resin fine particle-dispersed liquid 15 | 20.0 | Toner base particle-dispersed liquid 1 | 0.45 |
| Toner 10 | Organosilicon compound liquid 6 | 60.0 | Resin fine particle-dispersed liquid 2 | 20.0 | Toner base particle-dispersed liquid 1 | 0.61 |
| Toner 11 | Organosilicon compound liquid 7 | 60.0 | Resin fine particle-dispersed liquid 1 | 20.0 | Toner base particle-dispersed liquid 1 | 0.52 |
| Toner 12 | Organosilicon compound liquid 8 | 60.0 | Resin fine particle-dispersed liquid 1 | 20.0 | Toner base particle-dispersed liquid 1 | 0.51 |
| Toner 13 | Organosilicon compound liquid 9 | 60.0 | Resin fine particle-dispersed liquid 1 | 20.0 | Toner base particle-dispersed liquid 1 | 0.49 |
| Toner 14 | Organosilicon compound liquid 3 | 60.0 | Resin fine particle-dispersed liquid 3 | 2.0 | Toner base particle-dispersed liquid 1 | 0.31 |
| Toner 15 | Organosilicon compound liquid 3 | 60.0 | Resin fine particle-dispersed liquid 4 | 3.0 | Toner base particle-dispersed liquid 1 | 0.36 |
| Toner 16 | Organosilicon compound liquid 3 | 60.0 | Resin fine particle-dispersed liquid 5 | 6.0 | Toner base particle-dispersed liquid 1 | 0.43 |
| Toner 17 | Organosilicon compound liquid 3 | 60.0 | Resin fine particle-dispersed liquid 6 | 10.0 | Toner base particle-dispersed liquid 1 | 0.45 |
| Toner 18 | Organosilicon compound liquid 3 | 60.0 | Resin fine particle-dispersed liquid 7 | 40.0 | Toner base particle-dispersed liquid 1 | 0.89 |
| Toner 19 | Organosilicon compound liquid 3 | 60.0 | Resin fine particle-dispersed liquid 8 | 60.0 | Toner base particle-dispersed liquid 1 | 1.08 |
| Toner 20 | Organosilicon compound liquid 3 | 60.0 | Resin fine particle-dispersed liquid 9 | 100.0 | Toner base particle-dispersed liquid 1 | 1.27 |
| Toner 21 | Organosilicon compound liquid 4 | 60.0 | Resin fine particle-dispersed liquid 13 | 20.0 | Toner base particle-dispersed liquid 1 | 0.48 |
| Toner 22 | Organosilicon compound liquid 4 | 60.0 | Resin fine particle-dispersed liquid 14 | 20.0 | Toner base particle-dispersed liquid 1 | 0.55 |
| Toner 23 | Organosilicon compound liquid 5 | 60.0 | Resin fine particle-dispersed liquid 16 | 20.0 | Toner base particle-dispersed liquid 1 | 0.24 |
| Toner 24 | Organosilicon compound liquid 5 | 60.0 | Resin fine particle-dispersed liquid 17 | 20.0 | Toner base particle-dispersed liquid 1 | 0.35 |
| Toner 25 | Organosilicon | 60.0 | Resin fine | 20.0 | Toner base | 0.41 |

TABLE 4-continued

| | Organosilicon compound liquid | | Fine particle-dispersed liquid | | Toner base | |
|---|---|---|---|---|---|---|
| | Kind | Parts | Kind | Parts | particle-dispersed liquid | h/A |
| | compound liquid 5 | | particle-dispersed liquid 18 | | particle-dispersed liquid 1 | |
| Toner 26 | Organosilicon compound liquid 5 | 60.0 | Resin fine particle-dispersed liquid 19 | 20.0 | Toner base particle-dispersed liquid 1 | 0.56 |
| Toner 27 | Organosilicon compound liquid 5 | 60.0 | Resin fine particle-dispersed liquid 20 | 20.0 | Toner base particle-dispersed liquid 1 | 0.54 |
| Toner 28 | Organosilicon compound liquid 5 | 60.0 | Resin fine particle-dispersed liquid 21 | 20.0 | Toner base particle-dispersed liquid 1 | 0.70 |
| Toner 29 | Organosilicon compound liquid 6 | 60.0 | Resin fine particle-dispersed liquid 10 | 20.0 | Toner base particle-dispersed liquid 1 | 0.67 |
| Toner 30 | Organosilicon compound liquid 6 | 60.0 | Resin fine particle-dispersed liquid 11 | 20.0 | Toner base particle-dispersed liquid 1 | 0.74 |
| Toner 31 | Organosilicon compound liquid 6 | 60.0 | Resin fine particle-dispersed liquid 22 | 20.0 | Toner base particle-dispersed liquid 1 | 0.71 |
| Toner 32 | Organosilicon compound liquid 6 | 60.0 | Resin fine particle-dispersed liquid 23 | 20.0 | Toner base particle-dispersed liquid 1 | 0.69 |

<Method of Producing Comparative Toner 1>

The following samples were weighed in a reaction vessel, and were mixed with a propeller stirring blade.

| | |
|---|---|
| Resin fine particle-dispersed liquid 1 | 20.0 parts |
| Toner base particle-dispersed liquid 1 | 500.0 parts |

Next, diluted hydrochloric acid was added to adjust the pH of the mixed solution to 5.5. After the temperature of the mixed solution had been set to 70° C., the mixed solution was held for 1 hour while being stirred with a propeller stirring blade. After that, the pH of the whole was adjusted to 9.0 with a 1.0 mol/L aqueous solution of NaOH. Further, the resultant was held for 4 hours while being stirred, followed by air-cooling to a temperature of 25° C.

Diluted hydrochloric acid was added to the resultant mixed solution to adjust its pH to 1.5, and then the whole was stirred for 2 hours, followed by filtration, water washing, and drying. Thus, comparative toner particles 1 having protrusions derived from the resin fine particles on their surfaces were obtained. 2.0 Parts of silica particles having a number-average particle diameter of 100 nm, which had been treated with hexamethyldisilazane, were added to the comparative toner particles 1, and the mixture was stirred with a fluidized bed mixer (Mitsui Henschel Mixer, manufactured by Mitsui Miike Chemical Engineering Machinery Co., Ltd.) for 5 minutes to provide a comparative toner 1. In the comparative toner 1, the surface of each of the protrusions derived from the resin fine particles was not covered with the condensate of an organosilicon compound.

<Method of Producing Comparative Toner 2>

The following samples were weighed in a reaction vessel, and were mixed with a propeller stirring blade.

| | |
|---|---|
| Resin fine particle-dispersed liquid 1 | 20.0 parts |
| Toner base particle-dispersed liquid 1 | 500.0 parts |

Next, diluted hydrochloric acid was added to adjust the pH of the mixed solution to 4.0. After the temperature of the mixed solution had been set to 70° C., the mixed solution was held for 1 hour while being stirred with a propeller stirring blade. After that, 2.0 parts of an aqueous solution of the initial polymer of hexamethylolmelamine (solid content concentration: 80%) was added to the mixed solution, and the whole was stirred for 1 hour. After that, the pH of the resultant was adjusted to 7.0 with a 1.0 mol/L aqueous solution of NaOH. Further, the resultant was held for 4 hours while being stirred, followed by air-cooling to a temperature of 25° C.

Diluted hydrochloric acid was added to the resultant mixed solution to adjust its pH to 1.5, and then the whole was stirred for 2 hours, followed by filtration, water washing, and drying. Thus, comparative toner particles 2 having protrusions derived from the resin fine particles on their surfaces were obtained. 2.0 Parts of silica particles having a number-average particle diameter of 100 nm, which had been treated with hexamethyldisilazane, were added to the comparative toner particles 2, and the mixture was stirred with a fluidized bed mixer (Mitsui Henschel Mixer, manufactured by Mitsui Miike Chemical Engineering Machinery Co., Ltd.) for 5 minutes to provide a comparative toner 2. In the comparative toner 2, the surface of each of the protrusions derived from the resin fine particles was not covered with the condensate of an organosilicon compound.

<Method of Producing Comparative Toner 3>

The following samples were weighed in a reaction vessel, and were mixed with a propeller stirring blade.

| | |
|---|---|
| Resin fine particle-dispersed liquid 3 | 20.0 parts |
| Organosilicon compound liquid 5 | 60.0 parts |
| Toner base particle-dispersed liquid 1 | 500.0 parts |

Next, diluted hydrochloric acid was added to adjust the pH of the mixed solution to 5.5. After the temperature of the mixed solution had been set to 70° C., the mixed solution was held for 1 hour while being stirred with a propeller stirring blade. After that, the pH of the whole was adjusted to 9.0 with a 1.0 mol/L aqueous solution of NaOH. Further, the resultant was held for 4 hours while being stirred, followed by air-cooling to a temperature of 25° C.

Diluted hydrochloric acid was added to the resultant mixed solution to adjust its pH to 1.5, and then the whole was stirred for 2 hours, followed by filtration, water washing, and drying. Thus, comparative toner particles 3 having protrusions derived from the resin fine particles on their surfaces were obtained. The comparative toner particles were defined as a comparative toner 3. In the comparative toner 3, the layer of the condensate of the organosilicon compound was present between each of the resin fine particles and the toner base particle, and hence the resin fine particles were not in direct contact with the toner base particle.

<Method of Producing Comparative Toner 4>

500.0 g of the toner base particle-dispersed liquid 1 was weighed in a reaction vessel, and was stirred with a propeller stirring blade.

Next, diluted hydrochloric acid was added to adjust the pH of the mixed solution to 5.5. After the temperature of the mixed solution had been set to 70° C., the mixed solution was held for 1 hour while being stirred with a propeller stirring blade. After that, 60.0 parts of the organosilicon compound liquid 7 was added to the mixed solution, and the pH of the whole was adjusted to 9.0 with a 1.0 mol/L aqueous solution of NaOH. Further, the resultant was held for 4 hours while being stirred, followed by air-cooling to a temperature of 25° C.

Diluted hydrochloric acid was added to the resultant mixed solution to adjust its pH to 1.5, and then the whole was stirred for 2 hours, followed by filtration, water washing, and drying. Thus, comparative toner particles 4 were obtained. The comparative toner particles were defined as a comparative toner 4. In the comparative toner 4, protrusions derived from resin fine particles were not present.

[Evaluations of Examples 1 to 32 and Comparative Examples 1 to 4]

The evaluations of Examples 1 to 32 and Comparative Examples 1 to 4 were performed by using the toners 1 to 32 and the comparative toners 1 to 4, respectively.

First, a color laser printer (LBP-712Ci, manufactured by Canon Inc.) reconstructed so as to have a process speed of 300 mm/sec was used, and the toner of its cyan cartridge was removed. 120 g of each of the toners 1 to 32 and the comparative toners 1 to 4 was loaded into the cartridge. After that, the following evaluations were performed.

<Member Contamination Evaluation>

The cartridge was mounted on the cyan station of the printer, and a chart having a printing ratio of 5% was output on 1 sheet of A4 size plain paper Office 70 (manufactured by Canon Marketing Japan Inc., 70 g/m$^2$) under normal temperature and normal humidity (temperature: 23° C., humidity: 60% RH). After that, the image was output on 2 sheets of the paper, and the apparatus was stopped for 10 seconds. The foregoing operation was repeated, and every time the image was output on 1,000 sheets of the paper while the cartridge was replenished with the toner, the tops of a developing blade and a developing roller were visually observed, and the presence or absence of the occurrence of resin fusion was confirmed. Member contamination was evaluated by the following criteria through the use of the endurance number of sheets on which the resin fusion occurred as an indicator. The results are shown in Table 5.

A: No resin fusion occurs in each of the developing blade and the developing roller by the time when the image is output on 16,000 sheets.

B: The resin fusion occurs in the developing blade or the developing roller by the time when the image is output on 16,000 sheets.

C: The resin fusion occurs in the developing blade or the developing roller by the time when the image is output on 10,000 sheets.

D: The resin fusion occurs in the developing blade or the developing roller by the time when the image is output on 5,000 sheets.

<Transferability Evaluation>

The cartridge was mounted on the cyan station of the printer, and a chart having a printing ratio of 1% was output on 1 sheet of A4 size plain paper Office 70 (manufactured by Canon Marketing Japan Inc., 70 g/m$^2$) under normal temperature and normal humidity (temperature: 23° C., humidity: 60% RH), followed by the output of a solid image. The apparatus was stopped at the time of the transfer of the toner from a photosensitive member to an intermediate transfer member, and a toner laid-on level M1 (mg/cm$^2$) on the photosensitive member before the transfer step and a toner laid-on level M2 (mg/cm$^2$) on the photosensitive member after the transfer step were measured. The transfer efficiency of the toner was calculated from the following equation by using the measured toner laid-on levels, and was defined as initial transfer efficiency.

Further, the chart having a printing ratio of 1% was continuously output on 16,000 sheets of the paper while the cartridge was replenished with the toner. After that, the transfer efficiency of the toner was calculated and defined as transfer efficiency after endurance. The results are shown in Table 5.

$$\text{Transfer efficiency (\%)}=(M1-M2)/M1\times 100$$

The transferability of the toner was evaluated by the following evaluation criteria.

A: The transfer efficiency is 95% or more.

B: The transfer efficiency is 90% or more and less than 95%.

C: The transfer efficiency is 85% or more and less than 90%.

D: The transfer efficiency is less than 85%.

<Low-temperature Fixability>

The cartridge was mounted on the cyan station of the printer, and a solid image (toner laid-on level: 0.9 mg/cm$^2$) was output on A4 size plain paper Office 70 (manufactured by Canon Marketing Japan Inc., 70 g/m$^2$) under normal temperature and normal humidity (temperature: 23° C., humidity: 60% RH). The image was fixed while a fixation temperature was changed, and then the low-temperature fixability of the toner was evaluated. The A4 size plain paper Office 70 (manufactured by Canon Marketing Japan Inc., 70 g/m$^2$) was used as the paper. The results are shown in Table 5.

A: No offset occurs at 150° C.

B: An offset occurs at 150° C.

C: An offset occurs at 160° C.

D: An offset occurs at 170° C.

<Charge Rising Performance>

The process cartridge was mounted on the cyan station of the printer, and was left at rest in a low-temperature and low-humidity environment (15° C./10% RH, hereinafter referred to as "L/L environment") for 48 hours together with A4 size plain paper Office 70 (manufactured by Canon Marketing Japan Inc., 70 g/m$^2$).

In the L/L environment, an image having the following portions was output on the paper: a horizontal belt-like solid black image portion (laid-on level: 0.45 mg/cm$^2$) having a length of 10 mm, the portion ranging from a position distant from the leading end of the paper by 10 mm to a position distant therefrom by 20 mm when the paper was vertically viewed; a solid white image portion (laid-on level: 0.00 mg/cm$^2$) having a length of 10 mm in a downstream direction from the solid black image portion; and a halftone image portion (laid-on level: 0.20 mg/cm$^2$) having a length of 100 mm in a further downstream direction from the solid white image position. The charge rising performance of the toner was evaluated by the following criteria based on a difference between the image density of a portion on the halftone image portion positioned downstream from the solid black image portion by one round of the developing roller and the image density of a portion thereon positioned downstream from the solid white image portion by one round of the developing roller. The measurement of each of the image densities was performed by measuring a density relative to an image in a white ground portion having an image density of 0.00 with Macbeth Reflection Densitometer RD918 (manufactured by Macbeth) mounted with an amber filter in accordance with an attached instruction manual. The resultant relative density was defined as a value for the image density.

When the charge rising performance is satisfactory, the toner supplied onto a charging roller is rapidly charged. Accordingly, the image density after the solid black image portion and that after the solid white image portion do not differ from each other, and hence a satisfactory image is obtained.

(Evaluation Criteria for Charge Rising Performance)

A: The image density difference is less than 0.03, and hence the charge rising performance is extremely excellent.

B: The image density difference is 0.03 or more and less than 0.06, and hence the charge rising performance is excellent.

C: The image density difference is 0.06 or more and less than 0.10.

D: The image density difference is 0.10 or more.

TABLE 5

| | Toner | Member contamination | Initial transfer efficiency/% | | Transfer efficiency after endurance/% | | Fixability | Charge rising performance | |
|---|---|---|---|---|---|---|---|---|---|
| Example 1 | Toner 1 | A | A | 98 | A | 97 | A | A | 0.01 |
| Example 2 | Toner 2 | A | A | 99 | A | 97 | A | A | 0.01 |
| Example 3 | Toner 3 | A | A | 98 | A | 96 | A | A | 0.01 |
| Example 4 | Toner 4 | A | A | 98 | A | 96 | A | A | 0.01 |
| Example 5 | Toner 5 | A | A | 98 | A | 97 | A | A | 0.01 |
| Example 6 | Toner 6 | A | A | 98 | A | 96 | A | A | 0.02 |
| Example 7 | Toner 7 | A | A | 99 | A | 97 | A | A | 0.02 |
| Example 8 | Toner 8 | A | A | 99 | A | 97 | A | A | 0.02 |
| Example 9 | Toner 9 | A | B | 94 | B | 92 | A | B | 0.04 |
| Example 10 | Toner 10 | A | A | 97 | A | 95 | A | A | 0.02 |
| Example 11 | Toner 11 | B | A | 98 | A | 95 | A | A | 0.01 |
| Example 12 | Toner 12 | B | A | 96 | B | 93 | A | B | 0.05 |
| Example 13 | Toner 13 | C | B | 94 | C | 88 | A | C | 0.08 |
| Example 14 | Toner 14 | B | B | 93 | B | 91 | A | C | 0.09 |
| Example 15 | Toner 15 | A | A | 97 | A | 95 | A | B | 0.03 |
| Example 16 | Toner 16 | A | A | 98 | A | 96 | A | A | 0.02 |
| Example 17 | Toner 17 | A | A | 99 | A | 97 | A | A | 0.01 |
| Example 18 | Toner 18 | A | A | 99 | A | 98 | A | A | 0.01 |
| Example 19 | Toner 19 | B | A | 98 | A | 96 | A | A | 0.01 |
| Example 20 | Toner 20 | C | A | 99 | B | 94 | A | A | 0.02 |
| Example 21 | Toner 21 | A | A | 98 | A | 95 | A | B | 0.05 |
| Example 22 | Toner 22 | B | A | 97 | B | 94 | A | C | 0.08 |
| Example 23 | Toner 23 | C | B | 93 | C | 86 | A | B | 0.03 |
| Example 24 | Toner 24 | B | A | 95 | B | 92 | A | A | 0.02 |
| Example 25 | Toner 25 | A | A | 97 | A | 96 | A | A | 0.01 |
| Example 26 | Toner 26 | A | A | 99 | A | 97 | A | A | 0.01 |
| Example 27 | Toner 27 | A | A | 98 | A | 96 | A | A | 0.01 |
| Example 28 | Toner 28 | B | A | 96 | B | 94 | A | A | 0.01 |
| Example 29 | Toner 29 | B | A | 97 | B | 92 | B | A | 0.01 |
| Example 30 | Toner 30 | C | A | 98 | C | 89 | C | A | 0.01 |
| Example 31 | Toner 31 | C | A | 98 | C | 87 | C | C | 0.07 |
| Example 32 | Toner 32 | C | A | 99 | C | 85 | C | C | 0.06 |
| Comparative Example 1 | Comparative toner 1 | D | A | 97 | D | 84 | B | C | 0.07 |
| Comparative Example 2 | Comparative toner 2 | C | A | 99 | C | 87 | D | B | 0.05 |
| Comparative Example 3 | Comparative toner 3 | D | A | 99 | B | 93 | A | A | 0.01 |
| Comparative Example 4 | Comparative toner 4 | B | C | 89 | C | 86 | A | D | 0.12 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-96223, filed May 15, 2017, and Japanese Patent Application No. 2017-193187, filed Oct. 3, 2017, which are hereby incorporated by reference herein in their entirety.

What is claimed is:

1. A toner comprising a toner particle, said toner particle comprising:

a toner base particle containing a binder resin and a colorant;

resin fine particles; and a condensation product of an organosilicon compound represented by formula (1)

$$(R^a)_n—Si—(R^b)_{4-n} \quad (1)$$

where $R^a$ independently represents a halogen atom, a hydroxy group, or an alkoxy group, $R^b$ independently represents an alkyl group, an alkenyl group, an acetoxy group, an acyl group, an aryl group, an acryloxyalkyl group, or a methacryloxyalkyl group, and n represents an integer of from 2 to 4, wherein said toner particle has protrusions on a surface thereof, said protrusions being formed from said resin fine particles which are in direct contact with said toner base particle, and the surfaces of said protrusions being covered with said condensation product.

2. A toner according to claim 1, wherein n represents 2 or 3.

3. A toner according to claim 1, wherein the resin fine particle has a number-average particle diameter of 10 to 500 nm.

4. A toner according to claim 1, wherein the resin fine particle contains a thermoplastic resin.

5. A toner according to claim 1, wherein the resin fine particle has a glass transition temperature Tg of 40 to 110° C.

6. A toner according to claim 1, wherein the resin fine particle contains a resin comprising an ionic functional group.

* * * * *